US011839236B2

(12) United States Patent
An

(10) Patent No.: US 11,839,236 B2
(45) Date of Patent: Dec. 12, 2023

(54) AEROSOL GENERATION DEVICE

(71) Applicant: KT&G CORPORATION, Daejeon (KR)

(72) Inventor: Hwi Kyeong An, Seoul (KR)

(73) Assignee: KT&G CORPORATION, Daejeon (KR)

( * ) Notice: Subject to any disclaimer, the term of this patent is extended or adjusted under 35 U.S.C. 154(b) by 758 days.

(21) Appl. No.: 16/954,294

(22) PCT Filed: Jan. 22, 2019

(86) PCT No.: PCT/KR2019/000872
§ 371 (c)(1),
(2) Date: Jun. 16, 2020

(87) PCT Pub. No.: WO2019/164135
PCT Pub. Date: Aug. 29, 2019

(65) Prior Publication Data

US 2021/0137163 A1 May 13, 2021

(30) Foreign Application Priority Data

Feb. 21, 2018 (KR) ..... 10-2018-0020745

(51) Int. Cl.

| | |
|---|---|
| ***A24F 47/00*** | (2020.01) |
| ***A24F 40/40*** | (2020.01) |
| ***A24F 40/60*** | (2020.01) |
| *A24F 40/20* | (2020.01) |

(52) U.S. Cl.
CPC ..... *A24F 40/40* (2020.01); *A24F 40/60* (2020.01); *A24F 40/20* (2020.01)

(58) Field of Classification Search
None
See application file for complete search history.

(56) References Cited

U.S. PATENT DOCUMENTS

2017/0208868 A1 7/2017 Li et al.

FOREIGN PATENT DOCUMENTS

| | | | |
|---|---|---|---|
| CN | 2047487 | U | 11/1989 |
| CN | 203597398 | U | 5/2014 |
| CN | 203872987 | U | 10/2014 |
| KR | 10-1999-0026133 | A | 4/1999 |
| KR | 10-2001-0089445 | A | 10/2001 |

(Continued)

OTHER PUBLICATIONS

Chinese Office Action dated Nov. 18, 2022 in Chinese Application No. 201980007042.9.

(Continued)

*Primary Examiner* — Eric Yaary
(74) *Attorney, Agent, or Firm* — Sughrue Mion, PLLC

(57) ABSTRACT

Provided is an aerosol generation device including a first housing, a plurality of shutters, and a second housing. The first housing includes a first aperture into which a cigarette is inserted. The plurality of shutters are provided on the first housing to be rotatable about a virtual line extending in a lengthwise direction of the cigarette, and open and close the first aperture. The second housing includes a second aperture that communicates with the first aperture, surrounds an outer circumferential surface of the first housing to be rotatable with respect to the first housing, and slidably contacts the plurality of shutters and rotates the plurality of shutters according to a rotating manipulation by a user.

21 Claims, 17 Drawing Sheets

(56) References Cited

FOREIGN PATENT DOCUMENTS

| | | | |
|---|---|---|---|
| KR | 10-2006-0095623 | A | 9/2006 |
| KR | 10-0790156 | B1 | 1/2008 |
| KR | 10-2008-0072076 | A | 8/2008 |
| KR | 10-2015-0129366 | A | 11/2015 |
| KR | 10-2018-0014026 | A | 2/2018 |
| WO | 2013/012157 | A1 | 1/2013 |
| WO | 2015/117702 | A1 | 8/2015 |
| WO | 2015/174657 | A1 | 11/2015 |
| WO | 2016/207407 | A1 | 12/2016 |

OTHER PUBLICATIONS

Office Action issued from Korean Patent Application No. 10-2018-0020745 dated Jan. 10, 2020.

International Search Report for PCT/KR2019/000872 dated Apr. 26, 2019 (PCT/ISA/210).

Extended European Search Report dated Sep. 23, 2021, issued by the European Patent Office in application No. 19758241.4.

AEROSOL GENERATION DEVICE

TECHNICAL FIELD

The present disclosure relates to aerosol generation devices, and more particularly, to an aerosol generation device capable of opening or closing an aperture into which a cigarette is inserted, via a simple manipulation.

BACKGROUND ART

In general, when an aerosol generation device including a heater that heats a cigarette by using electricity is used, a cigarette that generated smoking gas by being heated by a heater may be separated from the aerosol generation device and replaced with a new cigarette.

Korean Patent Application Publication No. 10-2014-0117395 relates to a polygonal aerosol generation device that generates aerosol by heating a cigarette, and describes an aerosol generation device including a cavity into which a cigarette is inserted.

When a user uses an aerosol generation device having such structure, the smell of a cigarette permeates a cavity even after the cigarette is separated from the cavity. Thus, the smell may spread into a storage space, such as the user's pocket.

In addition, the heat with which the cigarette was heated may remain within the cavity and may cause the user to be burned. Thus, the inside of the aerosol generation device has to be cooled off for a certain period of time, which causes inconvenience to a user using an aerosol generation device.

DESCRIPTION OF EMBODIMENTS

Technical Problem

Provided is an aerosol generation device capable of opening or closing an aperture into which a cigarette is inserted, via a simple manipulation.

Also provided is an aerosol generation device capable of preventing internal smells or foreign materials from coming out, when the aerosol generation device is not used.

Also provided is an aerosol generation device capable of cooling off by discharging heated air that remains inside, even when an aperture is closed while the aerosol generation device is not in use.

Solution to Problem

According to an exemplary embodiment of the present disclosure, an aerosol generation device includes a first housing, a plurality of shutters, and a second housing. The first housing includes a first aperture into which a cigarette is inserted. The plurality of shutters are provided on the first housing to be rotatable about a virtual line extending in a lengthwise direction of the cigarette, and open and close the first aperture. The second housing includes a second aperture that communicates with the first aperture, surrounds an outer circumferential surface of the first housing to be rotatable with respect to the first housing, and slidably contacts the plurality of shutters and rotates the plurality of shutters according to a rotating manipulation by a user.

The first housing may further include first rotation shafts that protrude toward the plurality of shutters, the plurality of shutters may include rotation holes that accommodate the first rotation shafts, and the plurality of shutters may rotate about the first rotation shafts.

The plurality of shutters may be provided in the first housing on a same plane and are arranged circumferentially with respect to the center of the first aperture.

The plurality of shutters may include guiding protrusions that protrude toward the first housing, the first housing may further include guiding grooves that accommodate the guiding protrusions, and the guiding protrusions may slide along the guiding grooves with rotation of the plurality of shutters.

The guiding grooves may include fixing grooves configured to accommodate the guiding protrusions when the plurality of shutters close the first aperture and the second aperture, and moving grooves configured to slidably accommodate the guiding protrusions when the plurality of shutters open the first aperture and the second aperture. The guiding protrusions accommodated in the fixing grooves are fixed to the fixing grooves unless force greater than or equal to a threshold is applied to the plurality of shutters.

The first housing may further include maintaining protrusions that protrude toward the second housing. The second housing may further include maintaining grooves configured to slidably accommodate the maintaining protrusions. The maintaining protrusions may slide along the maintaining grooves with rotation of the second housing with respect to the first housing. As the maintaining protrusions are accommodated in the maintaining grooves, movement of the second housing with respect to the first housing in a lengthwise direction of the cigarette may be prevented.

The first housing may further include air flow holes allowing an air flow between the first housing and the second housing.

The plurality of shutters may include cam protrusions that protrude toward the second housing. The second housing may further include cam holes configured to slidably accommodate the cam protrusions. When the user rotates the second housing, rotation of the second housing may be delivered to the cam protrusions accommodated in the cam holes, and the cam protrusions may rotate the plurality of shutters by sliding along the cam holes.

Each of the plurality of shutters may include a step protruding toward another shutter, and a step groove configured to accommodate the step.

When the plurality of shutters close the first aperture and the second aperture, a portion of a gap formed between the plurality of shutters may be closed by the step, and the other portion of the gap formed between the plurality of shutters may be opened.

The second housing may further include a manipulation part that protrudes outwards from an outer circumferential surface of the second housing.

The aerosol generation device may further include a cover including a third aperture connected to the first and second apertures, the cover being coupled to the second housing.

The second housing may further include pressing protrusions configured to rotate the plurality of shutters by pressing the plurality of shutters according to rotation manipulation by the user.

The first housing may further include seating grooves inwardly formed in an opposite direction to a direction toward the plurality of shutters, protruding members formed on the seating grooves and protruding toward the plurality of shutters, elastic members provided on the seating grooves around the protruding members so as to have a certain elastic force, each elastic member having one end on which an elastic protrusion protruding toward the plurality of shutters is formed, fixing protrusions respectively fixing the elastic members onto the seating grooves, accommodating holes rotatably accommodating the plurality of shutters, and guiding grooves guiding rotation of the plurality of shutters. The plurality of shutters may include second rotation shafts protruding toward the first housing and rotatably accommodated in accommodating holes, guiding protrusions protruding toward the first housing and accommodated in the guiding grooves of the first housing, and guiding holes slidably accommodating the elastic protrusions. The elastic protrusions may slide along the guiding holes with rotation of the second housing with respect to the first housing, and the guiding protrusions may slide along the guiding grooves with rotation of the second housing with respect to the first housing.

When the plurality of shutters open or close the first aperture and the second aperture and the user does not rotate the second housing, the plurality of shutters may maintain opening or closing of the first aperture and the second aperture.

The elastic protrusions may be located at a first point within the guiding holes such that the plurality of shutters close the first aperture and the second aperture, and may located at a second point opposite to the first point within the guiding holes such that the plurality of shutters open the first aperture and the second aperture. When the elastic protrusions are located at the first point, the elastic protrusions may receive a restoration force of the elastic members in a direction from the first point back to the second point.

According to another exemplary embodiment of the present disclosure, an aerosol generation device includes a first housing including a first aperture into which a cigarette is inserted, and a plurality of shutters provided on the first housing to be rotatable about a virtual line extending in a width direction of the cigarette, and configured to open and close the first aperture.

The plurality of shutters may be provided in the first housing on a same plane and are arranged circumferentially with respect to the center of the first aperture.

The plurality of shutters may include third rotation shafts each extending in the width direction of the cigarette, and stoppers respectively defining critical positions of the plurality of shutters rotating about the third rotation shafts.

The plurality of shutters may further include elastic members configured to elastically support the first housing and the plurality of shutters such that the plurality of shutters elastically move between a first point for closing the first aperture and a second point for opening the first aperture.

The elastic members may be seated on installation holes formed in the first housing, and one side of each elastic member may be supported by an inner surface of the first housing and another side of each elastic member may be supported by an inner surface of each of the plurality of shutters.

A portion of each of the plurality of shutters, which is adjacent to the center of the first aperture when the plurality of shutters close the first aperture, may be chamfered.

These and/or other aspects will become apparent and more readily appreciated from the following description of the embodiments, taken in conjunction with the accompanying drawings.

Advantageous Effects of Disclosure

According to aerosol generation devices according to exemplary embodiments of the present disclosure as described above, a user is able to easily open or close an aperture into which a cigarette is inserted, with one hand, and thus, use of the aerosol generation devices is convenient.

In addition, when there is no manipulation by a user, the aperture into which a cigarette is inserted may be closed, and thus internal smells of the aerosol generation devices or foreign materials may be prevented from leaking to the outside.

Furthermore, a gap space provides fluid communication between the inside and outside of the aerosol generation devices even when the aperture is closed, and thus the heated air remaining after use is discharged from the gap space, thereby cooling down the aerosol generation devices.

BEST MODE

According to an exemplary embodiment of the present disclosure, an aerosol generation device includes a first housing, a plurality of shutters, and a second housing. The first housing includes a first aperture into which a cigarette is inserted. The plurality of shutters are provided on the first housing to be rotatable about a virtual line extending in a lengthwise direction of the cigarette, and open and close the first aperture. The second housing includes a second aperture that communicates with the first aperture, surrounds an outer circumferential surface of the first housing to be rotatable with respect to the first housing, and slidably contacts the plurality of shutters and rotates the plurality of shutters according to a rotating manipulation by a user.

MODE OF DISCLOSURE

The present disclosure will now be described more fully with reference to the accompanying drawings, in which exemplary embodiments of the disclosure are shown. The present disclosure may, however, be embodied in many different forms and should not be construed as being limited to the embodiments set forth herein; rather, these embodiments are provided so that the present disclosure will be thorough and complete, and will fully convey the concept of the disclosure to those skilled in the art. The scope of the present disclosure is only defined by the appended claims.

The terminology used herein is for the purpose of describing particular embodiments only and is not intended to limit the present disclosure. As used herein, the singular forms "a", "an" and "the" are intended to include the plural forms as well, unless the context clearly indicates otherwise. It will be understood that the terms "comprises" and/or "comprising," when used in this specification, specify the presence of stated components, steps, operations, and/or elements thereof, but do not preclude the presence or addition of one or more other components, steps, operations, and/or elements thereof.

While such terms as "first", "second", etc., may be used to describe various components, such components must not be limited to the above terms. The above terms are used only to distinguish one component from another.

Figure 1:
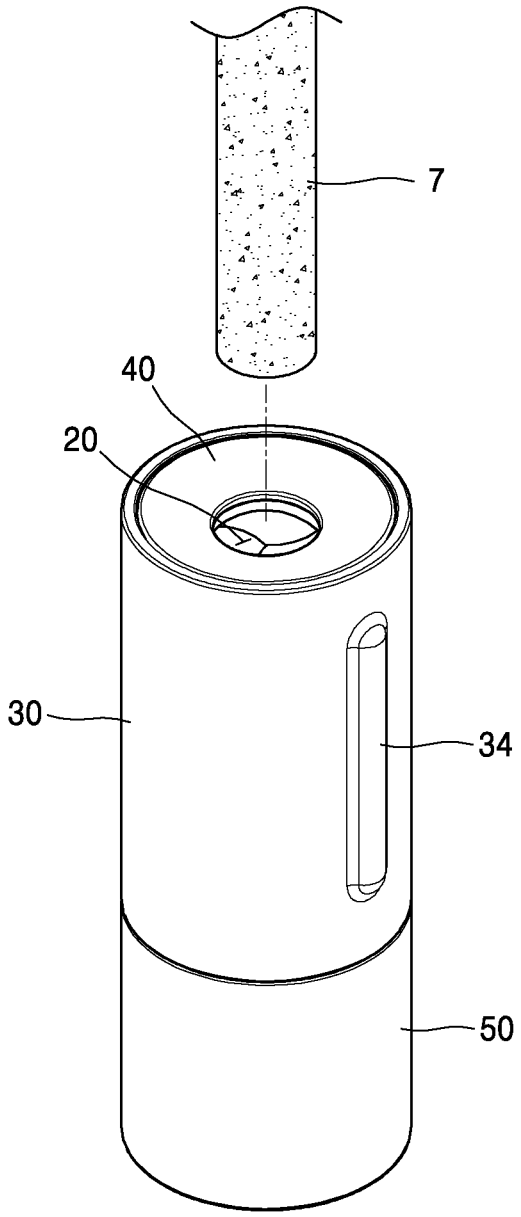
FIG. 1 is a perspective view of an outer appearance of an aerosol generation device according to an exemplary embodiment of the present disclosure.
Figure 2:
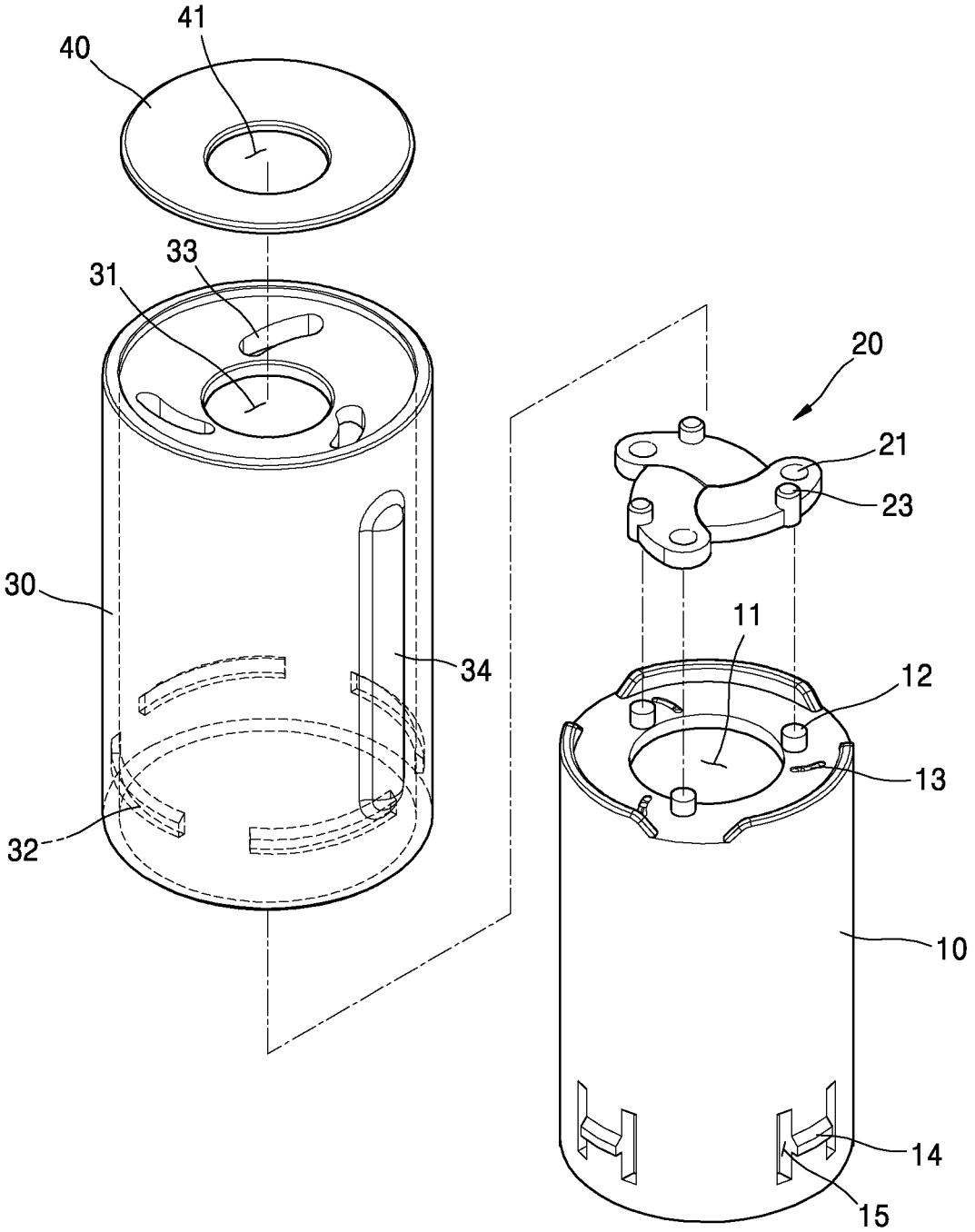
FIG. 2 is a schematic perspective view illustrating a combinational relationship between some components of the aerosol generation device of FIG. 1.

FIG. 1 is a perspective view of an aerosol generation device according to an exemplary embodiment of the present disclosure. FIG. 2 is a schematic exploded perspective view illustrating a combinational relationship between some components of the aerosol generation device of FIG. 1.

The aerosol generation device of FIGS. 1 and 2 includes a first housing 10, a plurality of shutters 20, and a second housing 30. The first housing 10 includes a first aperture 11 into which a cigarette 7 is inserted. The plurality of shutters 20 are provided on the first housing 10 to be rotatable about a virtual line extending in a lengthwise direction of the cigarette 7, and opens and closes the first aperture 11. The second housing 30 includes a second aperture 31 that communicates with the first aperture 11, surrounds an outer circumferential surface of the first housing 10 to be rotatable with respect to the first housing 10, and slidably contacts the plurality of shutters 20 and rotates the plurality of shutters 20 according to a rotating manipulation by a user.

The first housing 10 accommodates several components of the aerosol generation device within an internal space formed in the first housing 10 and protects the several components. Because the first housing 10 has an entirely-hollow cylindrical shape, an accommodating space (not shown) in which the cigarette 7 may be accommodated is formed within the first housing 10.

For example, a heater (not shown) heating the cigarette 7, and a support member (not shown) supporting the heater may be provided in the accommodating space. The first aperture 11, which is exposed to the outside and into which the cigarette 7 is insertable, is formed on one end of the accommodating space.

The first housing 10 may be manufactured using a plastic material that has low heat conductivity or does not transmit heat, or of a metal material on the surface of which a plastic material is coated. The accommodating space of the first housing 10 accommodates the cigarette 7 and provides a moving path of the cigarette 7 such that the cigarette 7 inserted from the outside may move along the accommodating space. Accordingly, the accommodating space of the first housing 10 may have a cylindrical shape corresponding to the shape of the cigarette 7. However, exemplary embodiments of the present disclosure are not limited by the shape of this accommodating space, and the shape of the accommodating space may also be an oval or a cross-section of a polygon like a quadrilateral. In this case, a separate support member (not shown) for fixing a cigarette may be provided in the accommodating space.

However, regardless of the shape of the accommodating space of the first housing 10, a cross section of the outer circumferential surface of the first housing 10 may have a circular shape in order to allow the second housing 30 to rotate relative to the first housing 10 by using a structure in which the inner circumferential surface of the second housing 30 and the outer circumferential surface of the first housing 10 engage with each other. This will be described below in greater detail.

In general, because the diameter of the accommodating space is greater than that of the cigarette 7, when the cigarette 7 is accommodated in the first housing 10, a certain space is formed between the accommodating space and the cigarette 7. The space between the accommodating space and the cigarette 7 may be connected to the outside via the first aperture 11, thereby forming a flow path through which the air may pass.

The plurality of shutters 20 are provided on a same plane in the first housing 10 and are arranged circumferentially with respect to the center of the first aperture 11. FIG. 2 depicts that three shutters 20 are arranged in the first housing 10 on the same plane in the circumferential direction with respect to the center of the first aperture 11. However, the number of shutters 20 of the aerosol generation device is not limited thereto.

For example, two or more shutters 20 may be included. As will be described later, the above arrangement is a structure for discharging remaining heat from the aerosol generation device by connecting the inside and outside of the aerosol generation device to each other even when the plurality of shutters 20 are closed. This structure is to provide a certain space between the plurality of shutters 20.

The second housing 30 forms the outer appearance of the aerosol generation device and thus accommodates and protects the first housing 10, the plurality of shutters 20, and several other components (not shown) within an internal space of the second housing 30. Because the second housing 30 has an entirely-hollow cylindrical shape, an accommodating space (not shown) for accommodating the above-described components may be formed within the second housing 30.

A second aperture 31 via which the cigarette 7 is insertable is formed on one end of the accommodating space, and, when the plurality of shutters 20 are open, the second aperture 31 may be connected to the first aperture 11 and may provide an accommodating space into which the cigarette 7 is inserted.

Similar to the first housing 10, the second housing 30 may be manufactured using a plastic material that has low heat conductivity or does not transmit heat, or of a metal material on the surface of which a plastic material is coated. The accommodating space of the second housing 30 receives the cigarette 7 and provides a moving path of the cigarette 7 such that the cigarette 7 inserted from the outside may move along the accommodating space. The accommodating space of the second housing 30 has a cylindrical shape corresponding to the shape of the first housing 10. However, exemplary embodiments of the present disclosure are not limited by the shape of the second housing 30. For example, the accommodating space may have a cross sectional shape corresponding to the first housing 10, such as a polygon (e.g., a quadrangle) or an oval.

However, regardless of the shape of the accommodating space of the second housing 30, a section of the inner circumferential surface of the second housing 30 in contact with the outer circumferential surface of the first housing 10 may have a circular shape, in order to allow the second housing 30 to rotate relative to the first housing 10 by using a structure in which the outer circumferential surface of the second housing 30 and the outer circumferential surface of the first housing 10 engage with each other. This will be described below in greater detail.

The second housing 30 further includes a manipulating part 34 that protrudes from the outer circumferential surface of the second housing 30 in an outward direction. A user may manipulate the manipulating part 34 to rotate the second housing 30 with respect to the first housing 10.

In detail, the user may rotate the second housing 30 with respect to the first housing 10 by pushing the manipulating part 34 with a finger while holding a base 50 of the aerosol generation device as shown in FIG. 1 with one hand. According to this rotation manipulation by the user, the plurality of shutters 20 may open the first aperture 11 and the second aperture 31, and the user may insert the cigarette 7 into the internal accommodating space of the aerosol generation device via the first aperture 11 and the second aperture 31 by using the other hand not holding the aerosol generation device.

Exemplary embodiments of the present disclosure are not limited to the presence or shape of the manipulating part 34 shown in the drawings. For example, the user may rotate the second housing 30 with respect to the first housing 10 by rotating the outer surface of the second housing 30 instead of the manipulating part 34. To this end, the outer surface of the second housing 30 may be formed of a material having a sufficient frictional force to rotate the second housing 30 via a manipulation of the user. However, for convenience of explanation, it is assumed hereinafter that the manipulating part 34 is formed on the outer surface of the second housing 30.

The aerosol generation device may include a third aperture 41 connected to the first aperture 11 and the second aperture 31, and may further include a cover 40 that is coupled to the second housing 30. The cover 40 may improve the aesthetic by covering cam holes 33 formed on an upper surface of the second housing 30, and cam protrusions 23 accommodated in the cam holes 33.

Figure 3:
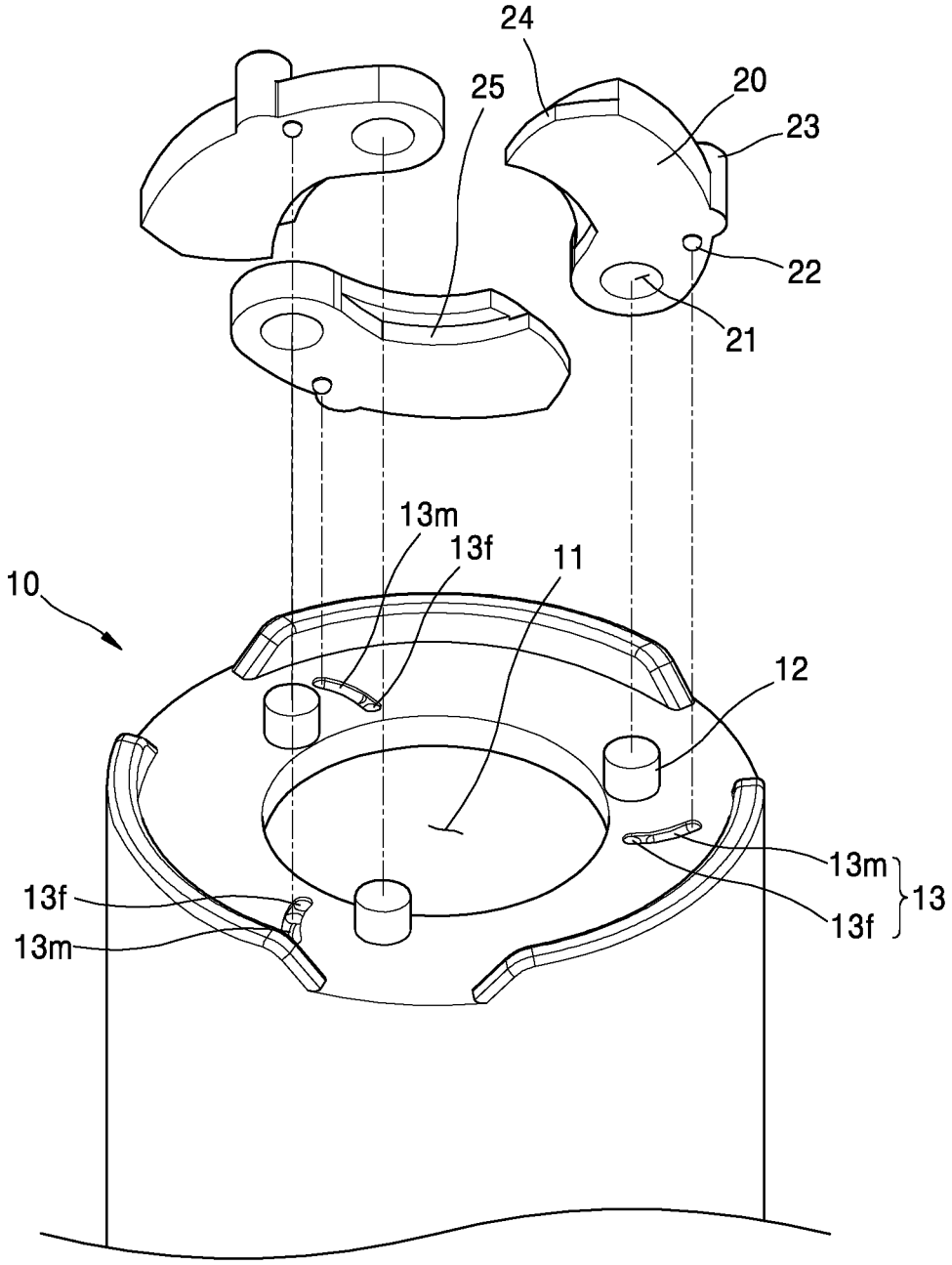
FIG. 3 is an exploded perspective view illustrating a combinational relationship between a first housing and a plurality of shutters of the aerosol generation device of FIG. 1.

FIG. 3 is an exploded perspective view illustrating a combinational relationship between the first housing 10 and the plurality of shutters 20 of the aerosol generation device of FIG. 1.

Referring to FIG. 3, the first housing 10 further includes first rotation shafts 12 protruding toward the plurality of shutters 20, and guiding grooves 13 guiding rotation of the plurality of shutters 20. The first rotation shafts 12 may be accommodated in rotation holes 21 of the plurality of shutters 20, and the plurality of shutters 20 may rotate about the first rotation shafts 12.

The plurality of shutters 20 include guiding protrusions 22 protruding toward the first housing 10. The guiding protrusions 22 may be accommodated in the guiding grooves 13 of the first housing 10, and may slide along the guiding grooves 13 with rotation of the plurality of shutters 20. The plurality of shutters 20 further include cam protrusions 23, steps 24 and step grooves 25, which will be described below in detail with reference to FIGS. 5 and 6.

The guiding grooves 13 include fixing grooves **13*f* accommodating the guiding protrusions 22 when the plurality of shutters 20 close the first aperture 11 and the second aperture 31, and moving grooves 13*m* slidably accommodating the guiding protrusions 22 when the plurality of shutters 20 open the first aperture 11 and the second aperture 31. Because FIG. 3 illustrates a state in which the plurality of shutters 20 are open, the guiding protrusions 22 of the plurality of shutters 20 of FIG. 3 are depicted as being accommodated in the moving grooves 13*m*. Although not shown in the drawings, when the plurality of shutters 20 are closed, the guiding protrusions 22 of the plurality of shutters 20 are accommodated in the fixing grooves 13*f***.

In detail, force that is equal to or greater than a threshold value needs to be applied to take the guiding protrusions 22 accommodated in the fixing grooves **13*f* out of the fixing grooves 13*f*. In other words, when the plurality of shutters 20 close the first aperture 11 and the second aperture 31, the plurality of shutters 20 may continuously maintain the closed state unless the user rotates the second housing 30** by using the force that is equal to or greater than the threshold value.

Accordingly, in the aerosol generation device according to an exemplary embodiment of the present disclosure, when there is no manipulation by a user, the first aperture 11 and the second aperture 31 are maintained closed, and thus internal smells or foreign materials may be prevented from leaking to the outside because of exposure of the accommodating space to the outside.

After a user takes the guiding protrusions 22 out of the fixing grooves **13*f* by rotating the second housing 30 with the force that is equal to or greater than the threshold value, the guiding protrusions 22 may slide along the moving grooves 13*m*. FIG. 3 depicts that the guiding protrusions 22 are located on the moving grooves 13*m* that are farthest from the fixing grooves 13*f*. This means a state where the plurality of shutters 20** are maximally open.

Figure 4:
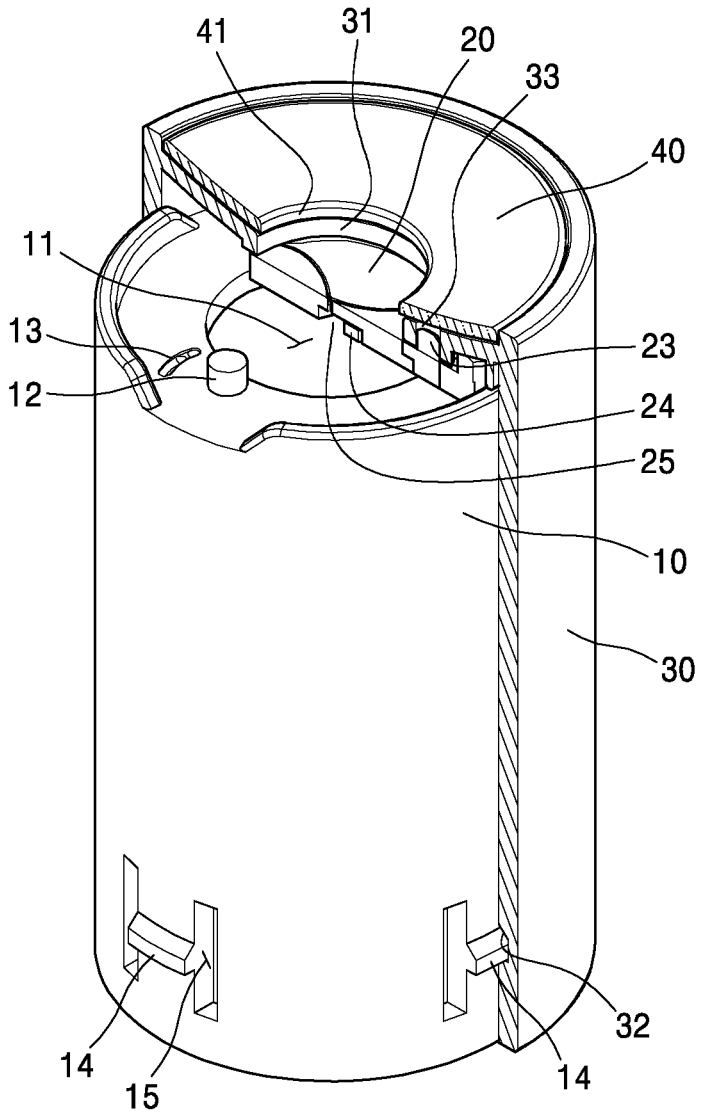
FIG. 4 is an exploded perspective view illustrating a combinational relationship between the first housing and a second housing of the aerosol generation device of FIG. 1.

FIG. 4 is an exploded perspective view illustrating a combinational relationship between the first housing 10 and the second housing 30 of the aerosol generation device of FIG. 1.

Referring to FIGS. 2 and 4, the first housing 10 further includes maintaining protrusions 14 protruding toward the second housing 30, and the second housing 30 further includes maintaining grooves 32 slidably accommodating the maintaining protrusions 14. The maintaining protrusions 14 may slide along the maintaining grooves 32 with rotation of the second housing 30 with respect to the first housing 10.

Although not illustrated in the drawings in detail, the base 50, which accommodates a circuit board (not shown) and a battery (not shown) of the aerosol generation device, is connected to a bottom side of the first housing 10 opposite to a top side of the first housing 10 via which the cigarette 7 is inserted. The first housing 10 is fixed to the base 50, and, when a user wants to insert the cigarette 7, the user generally rotates the second housing 30 while holding the base 50. Thus, the second housing 30 may rotate with respect to the first housing 10.

As such, due to a coupling structure in which the maintaining protrusions 14 formed on the outer circumferential surface of the first housing 10 and protruding outwards are coupled with the maintaining grooves 32 formed inwardly in the inner circumferential surface of the second housing 30 to accommodate the maintaining protrusions 14, the second housing 30 may rotate with respect to the first housing 10 about a central axis (not indicated) of the first aperture 11.

The maintaining grooves 32 may allow movement of the maintaining protrusions 14 in a width direction of the cigarette 7 (a horizontal direction) but may prevent movement of the maintaining protrusions 14 in a lengthwise direction of the cigarette 7. According to this structure, the second housing 30 may rotate with respect to the first housing 10 about the central axis of the first aperture 11, but movement of the second housing 30 in the lengthwise direction of the cigarette 7, namely, in a vertical direction in the drawings, is prevented. In other words, the second housing 30 may rotate with respect to the first housing 10 about the central axis of the first aperture 11 along the outside surface of the first housing 10 without moving in the lengthwise direction of the cigarette 7.

The first housing 10 further includes air flow holes 15 allowing an air flow between the first housing 10 and the second housing 30. Because the air flow holes 15 are connected to an internal accommodating space of the first housing 10, the external air flowing into the aerosol generation device may also be delivered into the internal accommodating space of the first housing 10 via a gap formed between the first housing 10 and the second housing 30.

Figure 5:
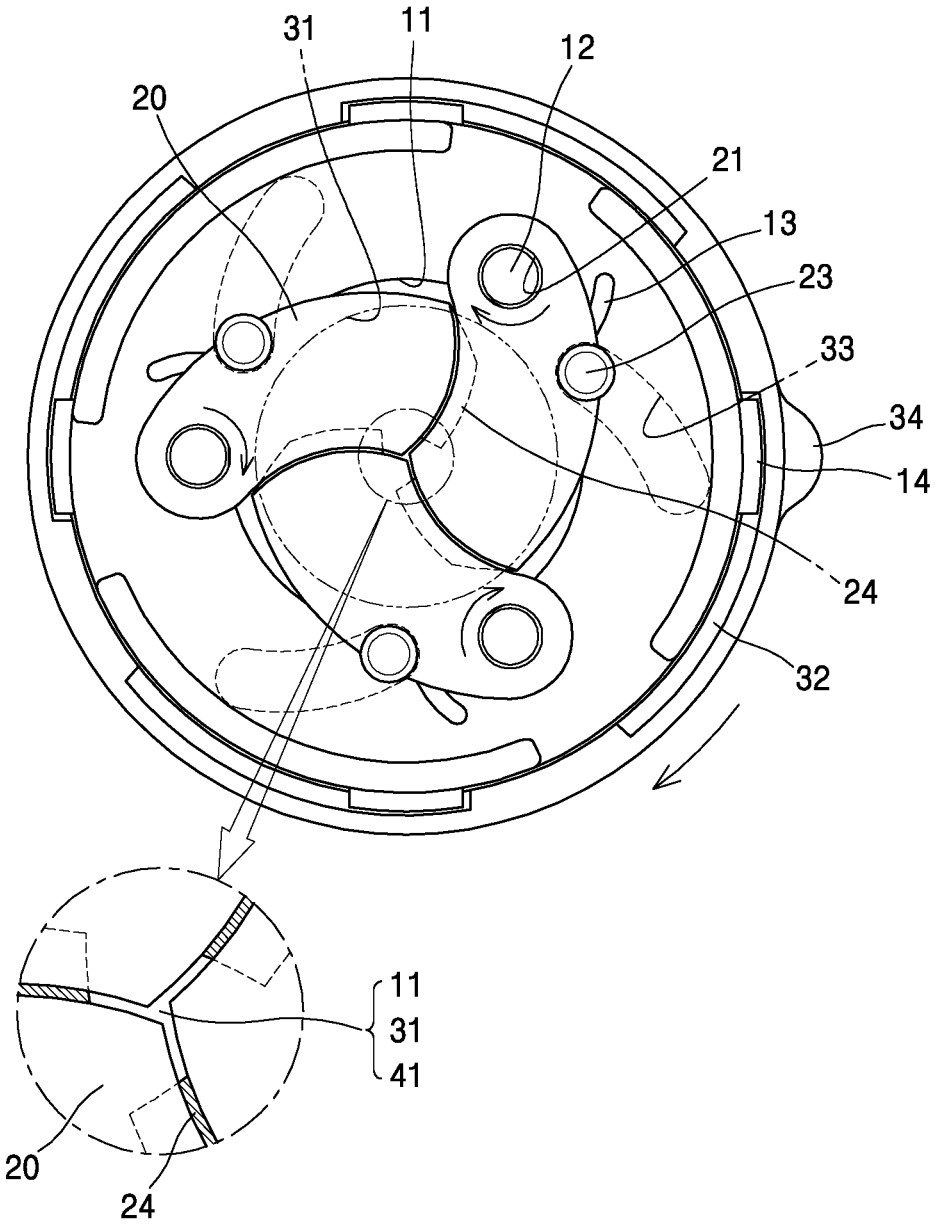
FIG. 5 is a perspective plan view illustrating a state in which the plurality of shutters of the aerosol generation device of FIG. 1 are closed.

FIG. 5 is a perspective plan view illustrating a state in which the plurality of shutters 20 of the aerosol generation device of FIG. 1 are closed.

Referring to FIG. 5, the plurality of shutters 20 include the cam protrusions 23 protruding toward the second housing 30, and the second housing 30 further includes the cam holes 33 slidably accommodating the cam protrusions 23. When a user rotates the second housing 30, the rotation of the second housing 30 is delivered to the cam protrusions 23 accommodated in the cam holes 33, and the cam protrusions 23 may rotate the plurality of shutters 20 by sliding along the cam holes 33.

FIG. 5 illustrates that the plurality of shutters 20 close the first aperture 11 and the second aperture 31. In other words, each of the plurality of shutters 20 contacts other shutters 20 by rotating clockwise about the first rotation shafts 12. In the case of FIG. 5, three shutters 20 are brought together to close the first aperture 11 and the second aperture 31.

Although described above, a state in which the plurality of shutters 20 close the first aperture 11 and the second aperture 31 refers to a normal state in which there is no user's manipulation. In this case, although not shown in FIG. 5, the guiding protrusions 22 of FIG. 3 of the plurality of shutters 20 may be accommodated in the fixing grooves 13*f* of the guiding grooves 13.

As the plurality of shutters 20 rotate clockwise about the first rotation shafts 12, the cam protrusions 23 may be arranged adjacent to the center of the first aperture 11. As will be described later with respect to FIG. 6, when the plurality of shutters 20 rotate in the counterclockwise direction, the cam protrusions 23 may move in a direction away from the center of the first aperture 11 with rotation of the plurality of shutters 20. This is because, when the second housing 30 moves counterclockwise due to rotation manipulation by a user, the cam holes 33 formed in the second housing 30 also move counterclockwise, and the cam protrusions 23 accommodated in the cam holes 33 move along a path provided by the cam holes 33.

Each of the plurality of shutters 20 may further include a step 24 protruding toward another shutter 20, and a step groove 25 (see FIG. 3) accommodating the step 24. As shown in FIG. 5, when the plurality of shutters 20 close the first aperture 11 and the second aperture 31, portions of gaps formed between the plurality of shutters 20 may be closed by the steps 24, and at the same time respective other portions of the gaps between the plurality of shutters 20 may be open.

As described above, the internal accommodating space of the aerosol generation device is closed by closing the plurality of shutters 20. As such, a smell of the cigarette 7 remaining after use within the aerosol generation device may be prevented from being rapidly diffused to the outside. In addition, due to application of a structure that opens a certain space between the plurality of shutters 20, heat remaining within the aerosol generation device after use may be discharged to the outside, thereby cooling down the aerosol generation device.

Figure 6:
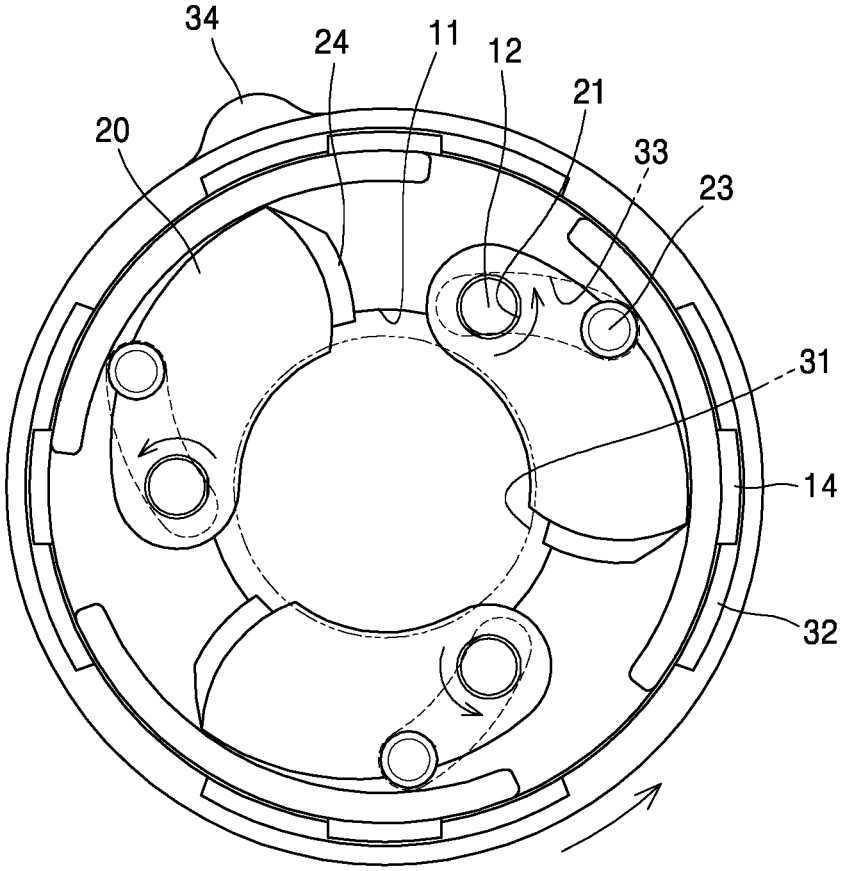
FIG. 6 is a perspective plan view illustrating a state in which the plurality of shutters of the aerosol generation device of FIG. 1 are opened.

FIG. 6 is a perspective plan view illustrating a state in which the plurality of shutters 20 of the aerosol generation device of FIG. 1 are opened.

FIG. 6 illustrates a state in which the plurality of shutters 20 open the first aperture 11 and the second aperture 31 as a result of a user rotating the second housing 30 in the counterclockwise direction by manipulating the manipulating part 34. When the second housing 30 rotates counterclockwise, the cam holes 33 formed in the second housing 30 also move counterclockwise, and, according to the movement of the cam holes 33, the cam protrusions 23 accommodated in the cam holes 33 also move counterclockwise.

The cam protrusions 23 move in a direction away from the center of the first aperture 11 by sliding along the cam holes 33, and consequently, the cam protrusions 23 also move counterclockwise about the first rotation shafts 12 and thus move to a position opposite to the position of the cam protrusions 23 within the cam holes 33 shown in FIG. 5.

In other words, when the user rotates the second housing 30 in the counterclockwise direction, the cam protrusions 23 also rotate in the counterclockwise direction about the first rotation shafts 12 as a result, and consequently the plurality of shutters 20 also rotate in the counterclockwise direction about the first rotation shafts 12 to open the first aperture 11 and the second aperture 31.

When the plurality of shutters 20 open the first aperture 11 and the second aperture 31 as described above, the user may insert the cigarette 7 into the internal accommodating space of the aerosol generation device with a hand not holding the aerosol generation device.

In other words, the user may conveniently open or close the internal accommodating space of the aerosol generation device with one hand, without a need for a separate component for performing such functions.

Figure 7:
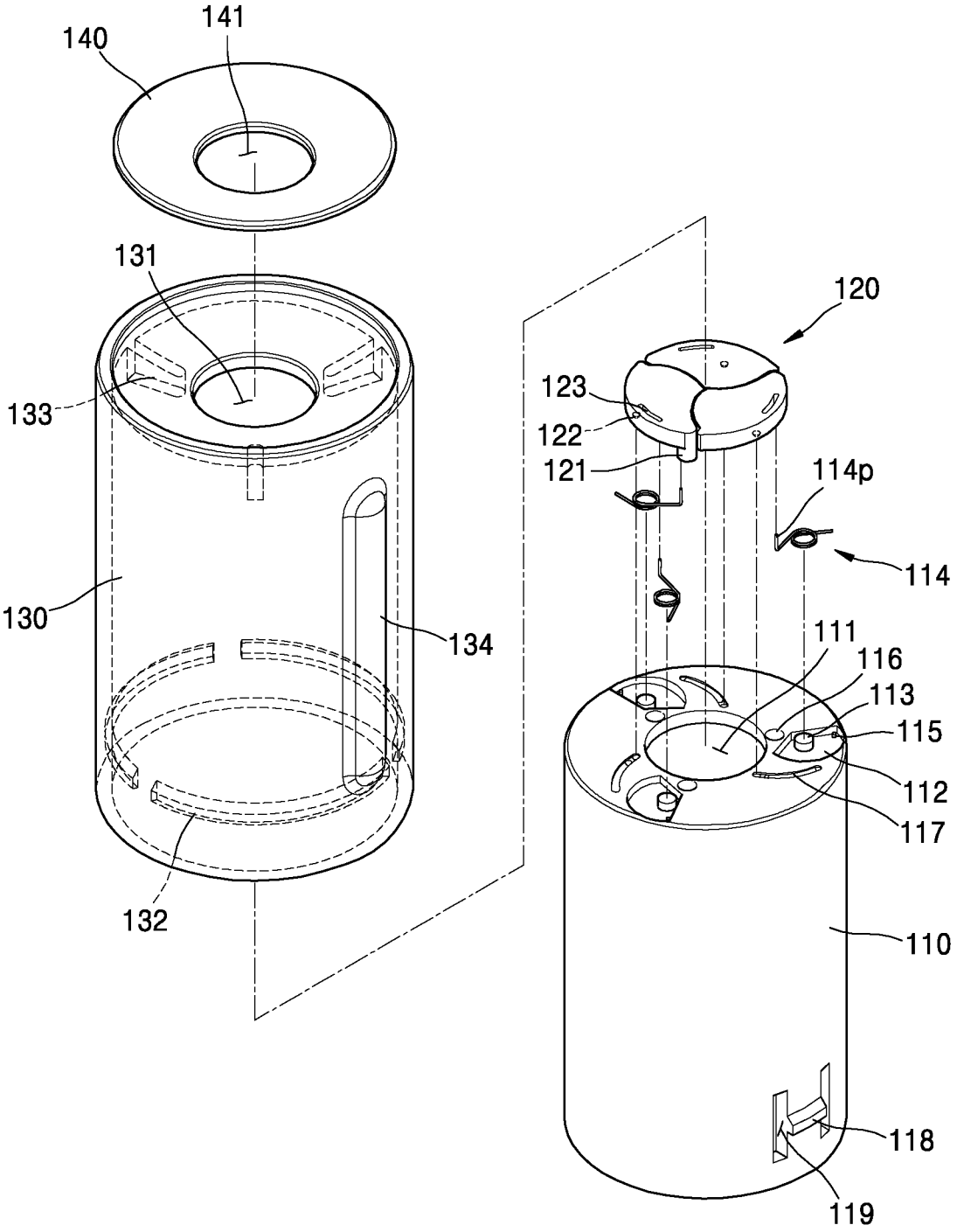
FIG. 7 is a schematic exploded perspective view illustrating a combinational relationship between some components of an aerosol generation device according to another exemplary embodiment of the present disclosure.
Figure 8:
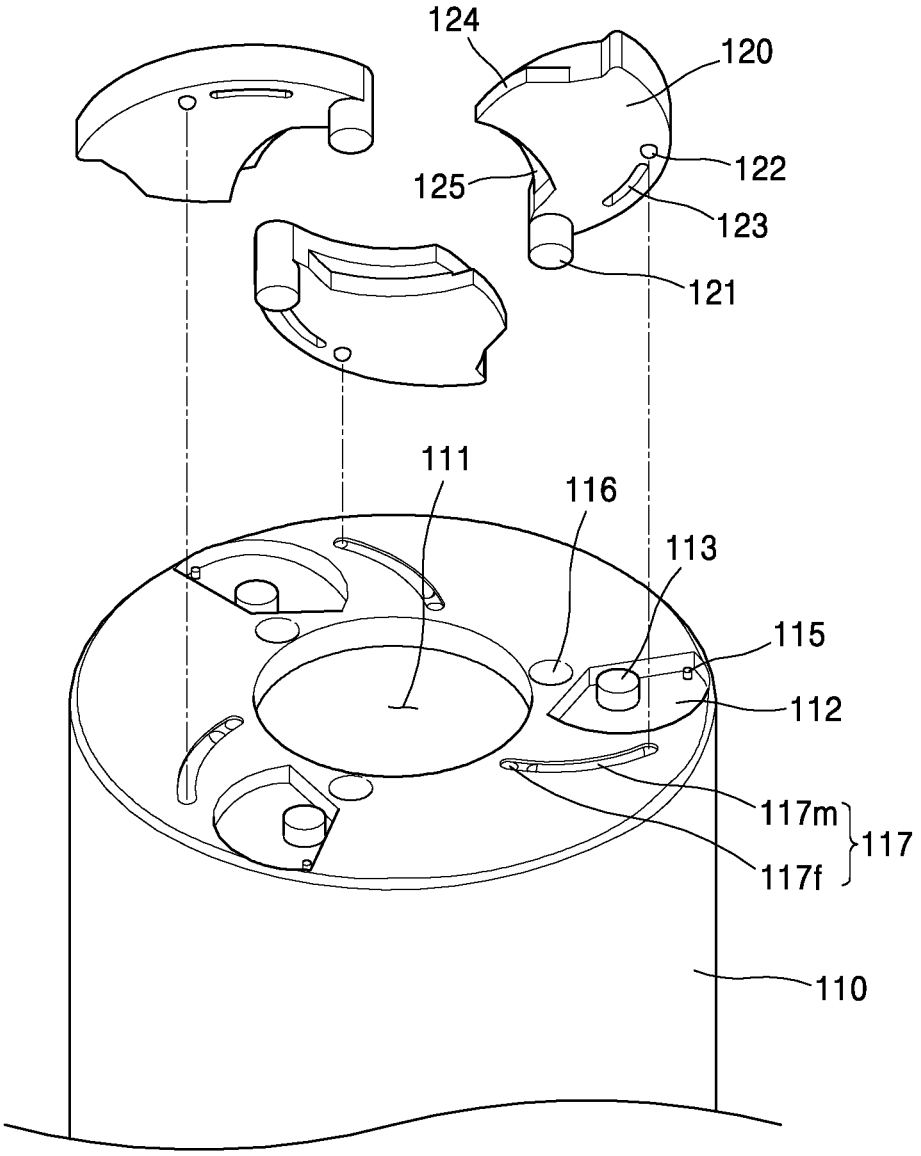
FIG. 8 is an exploded perspective view illustrating a combinational relationship between a first housing and a plurality of shutters of the aerosol generation device of FIG. 7.

FIG. 7 is a schematic exploded perspective view illustrating a combinational relationship between some components of an aerosol generation device according to another exemplary embodiment of the present disclosure, and FIG. 8 is an exploded perspective view illustrating a combinational relationship between the first housing 110 and a plurality of shutters 120 of the aerosol generation device of FIG. 7.

In the aerosol generation device of FIG. 7, when there is no rotation manipulation by a user, the plurality of shutters 120 may continuously maintain an open state or a close state, and the plurality of shutters 120 may be opened or closed due to rotation manipulation by a user.

Referring to FIGS. 7 and 8, the first housing 110 includes seating grooves 112 inwardly formed opposite the plurality of shutters 120, protruding members 113 formed on the seating grooves 112 and protruding toward the plurality of shutters 120, elastic members 114 provided on the seating grooves 112 around the protruding members 113 to provide elastic force, the elastic members 114 having respective one ends on which elastic protrusions 114*p* protruding toward the plurality of shutters 120 are formed, respectively, fixing protrusions 115 fixing the elastic members 114 onto the seating grooves 112, accommodating holes 116 rotatably accommodating the plurality of shutters 120, and guiding grooves 117 guiding rotation of the plurality of shutters 120.

The plurality of shutters 120 include second rotation shafts 121 protruding toward the first housing 110 and rotatably accommodated in accommodating holes 116, guiding protrusions 122 protruding toward the first housing 110 and accommodated in guiding grooves 117 of the first housing 110, and guiding holes 123 slidably accommodating the elastic protrusions 114*p*.

The second housing 130 further includes pressing protrusions 133 that rotate the plurality of shutters 120 by pressing the plurality of shutters 120 according to a rotation manipulation by a user or maintain the plurality of shutters 120 in a closed state.

The first housing 110 further includes maintaining protrusions 118 protruding toward the second housing 130, and the second housing 130 further includes maintaining grooves 132 slidably accommodating the maintaining protrusions 118. The maintaining protrusions 118 may slide along the maintaining grooves 132 with rotation of the second housing 130 with respect to the first housing 110.

Although not illustrated in the drawings in detail, the base 50 of FIG. 1, which accommodates a circuit board (not shown) and a battery (not shown) of the aerosol generation device, is connected to a bottom side of the first housing 110 opposite to a top side of the first housing 110 via which the cigarette 7 is inserted. The first housing 110 is fixed to the base 50, and, when a user wants to insert the cigarette 7, the user generally rotates the second housing 130 while fixing the base 50 with one hand. Thus, a structure in which the second housing 30 is rotatable with respect to the first housing 110 may be implemented.

As such, due to a coupling structure in which the maintaining protrusions 118 formed on the outer circumferential surface of the first housing 110 and protruding outwards are coupled with the maintaining grooves 132 formed inwardly in the inner circumferential surface of the second housing 130 to accommodate the maintaining protrusions 118, the second housing 130 may rotate with respect to the first housing 110 about a central axis (not indicated) of the first aperture 111.

The maintaining grooves 132 may allow movement of the maintaining protrusions 14 in a width direction of the cigarette 7 (a horizontal direction) but may prevent movement of the maintaining protrusions 118 in a lengthwise direction of the cigarette 7. According to this structure, the second housing 130 may rotate with respect to the first housing 110 about the central axis of the first aperture 111, but movement of the second housing 30 in the lengthwise direction of the cigarette 7, namely, in a vertical direction in the drawings, is prevented. In other words, the second housing 130 may rotate with respect to the first housing 110 about the central axis of the first aperture 111 along the outside surface of the first housing 110 when the cigarette 7 while being fixed in the lengthwise direction of the cigarette 7.

The first housing 110 further includes air flow holes 119 allowing an air flow between the first housing 110 and the second housing 130. Because the air flow holes 119 are connected to an internal accommodating space of the first housing 110, the external air flowing into the aerosol generation device may also be delivered into the internal accommodating space of the first housing 110 via a gap formed between the first housing 110 and the second housing 130. The elastic protrusions 114*p* may slide along the guiding holes 123 as the second housing 130 rotates with respect to the first housing 110. The elastic protrusions 114*p* are located at a first point P1 (see FIG. 9) within the guiding holes 123 when the plurality of shutters 120 are closed, and are located at a second point P2 (see FIG. 9) within the guiding holes 123 when the plurality of shutters 120 are open. When the elastic protrusions 114*p* are located at the first point P1, the elastic protrusions 114*p* receive restoration force of the elastic protrusions 114*p* in a direction from the first point P1 back to the second point P2.

The guiding protrusions 122 may be accommodated in the guiding grooves 117 of the first housing 110, and may slide along the guiding grooves 117 with rotation of the plurality of shutters 120. The plurality of shutters 120 further include steps 124 and step grooves 25, and the steps 24 and the step grooves 125 will be described below in detail with reference to FIGS. 9 and 10.

Figure 9:
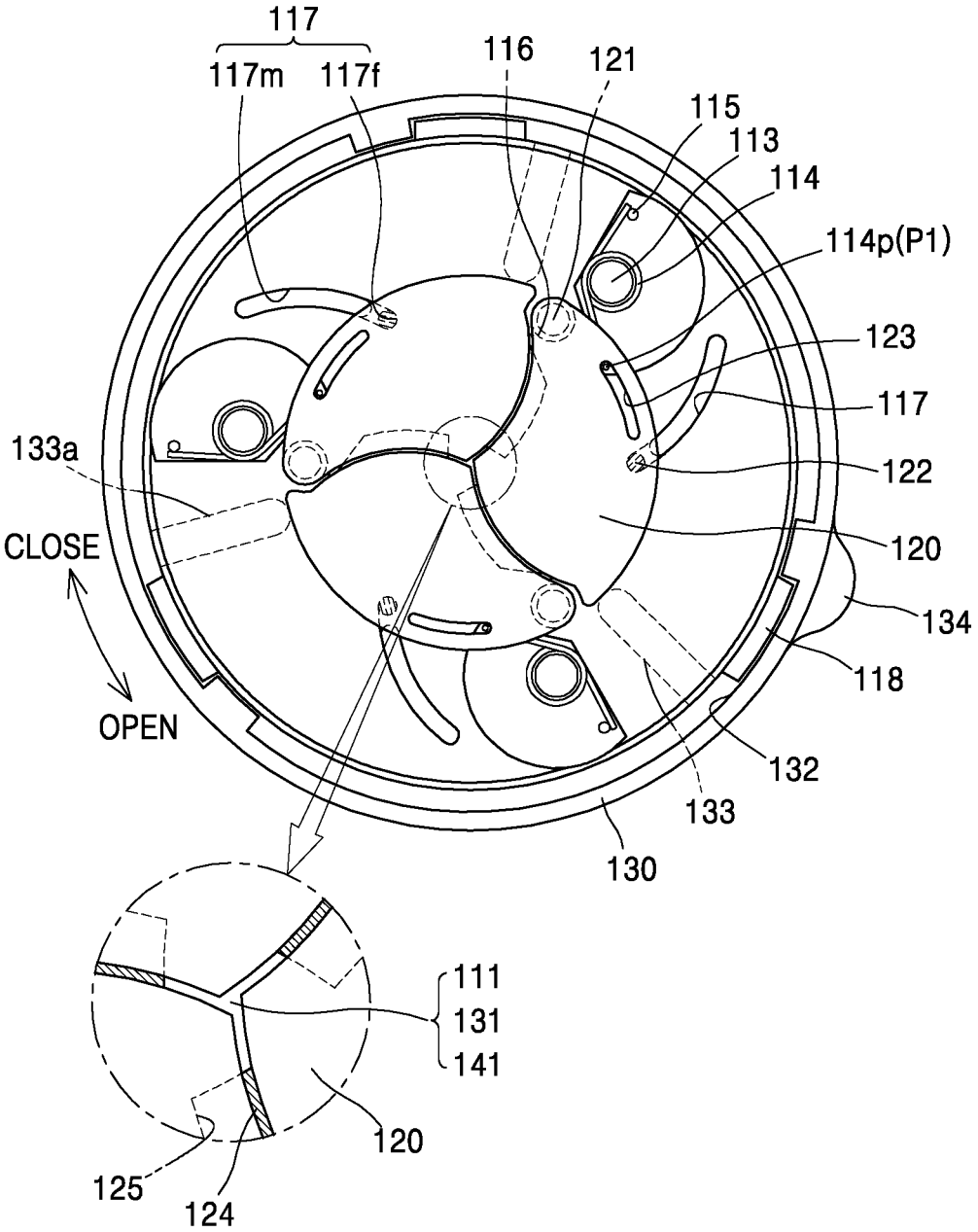
FIG. 9 is a perspective plan view illustrating a state in which the plurality of shutters of the aerosol generation device of FIG. 7 are closed.
Figure 10:
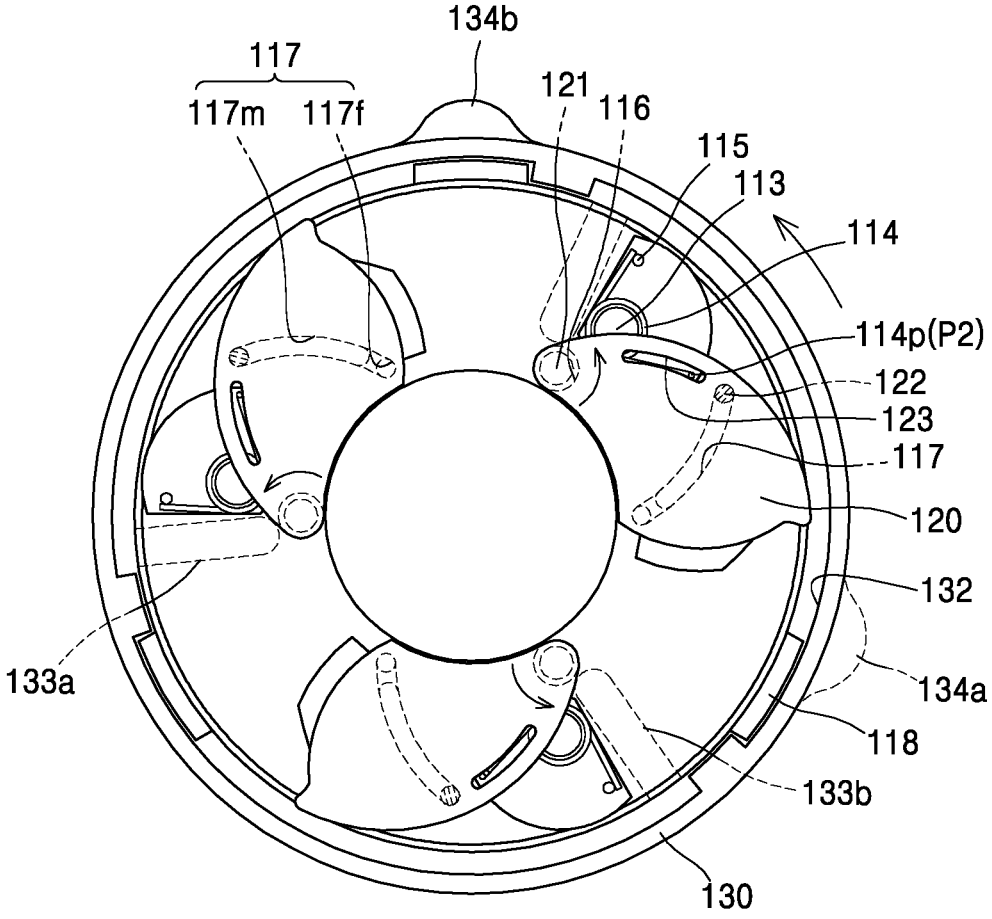
FIG. 10 is a perspective plan view illustrating a state in which the plurality of shutters of the aerosol generation device of FIG. 7 are opened.

The guiding grooves 117 include fixing grooves 117*f* accommodating the guiding protrusions 122 when the plurality of shutters 120 close the first aperture 111 and the second aperture 131, and moving grooves 117*m* slidably accommodating the guiding protrusions 122 when the plurality of shutters 120 open the first aperture 111 and the second aperture 131. Because FIGS. 7 and 9 illustrate a state in which the plurality of shutters 120 are closed, the guiding protrusions 122 of the plurality of shutters 120 of FIGS. 7 and 9 may be accommodated in the fixing grooves 117*f*. Because FIGS. 8 and 10 illustrate a state in which the plurality of shutters 120 are open, the guiding protrusions 122 of the plurality of shutters 120 of FIGS. 8 and 10 may be accommodated in the moving grooves 117*m*.

In detail, force that is equal to or greater than a threshold value needs to be applied to take the guiding protrusions 122 accommodated in the fixing grooves 117*f* out of the fixing grooves 117*f*. In other words, once the plurality of shutters 120 close the first aperture 111 and the second aperture 131, the plurality of shutters 120 may continuously maintain the closed state, unless the user applies rotation force to open the plurality of shutters 120 by rotating the second housing 130 by using the force that is equal to or greater than the threshold value.

When the plurality of shutters 120 are closed as shown in FIG. 9, the pressing protrusions 133 of the second housing 130 may press respective ends of the plurality of shutters 120 that are away from the second rotation shafts 121, to maintain the closed state of the plurality of shutters 120, thereby restricting rotation of the plurality of shutters 120.

When the user rotates the second housing 130 in the counterclockwise direction by manipulating a manipulating part 134 (from a location 134*a* to a location 134*b* of FIG. 10), the pressing protrusions 133 may allow rotation of the plurality of shutters 120 such that the plurality of shutters 120 rotate from a close state to an open state (in the counterclockwise direction in FIGS. 9 and 10) due to a restoration force of the elastic members 114.

In other words, the pressing protrusions 133 move by a user's manipulation from a location 133*a* of FIG. 9 where the pressing protrusions 133 press respective ends of the plurality of shutters 120 away from the second rotation shafts 121 to a location 133*b* of FIG. 10 where the pressing protrusions 133 press respective ends of the plurality of shutters 120 adjacent to the second rotation shafts 121. Accordingly, the plurality of shutters 120 may rotate from the close state to the open state.

Accordingly, in the aerosol generation device according to another exemplary embodiment of the present disclosure, when the plurality of shutters 120 are closed and there is no manipulation by a user, the first aperture 111 and the second aperture 131 are maintained closed, and thus internal smells or foreign materials may be prevented from leaking to the outside because of exposure of the accommodating space of the aerosol generation device to the outside.

After the user takes the guiding protrusions 122 out of the fixing grooves 117*f* by rotating the second housing 130 with the force that is equal to or greater than the threshold value, the guiding protrusions 122 may slide along the moving grooves 117*m*. FIGS. 8 and 10 depict that the guiding protrusions 122 are located on the moving grooves 117*m* that are farthest from the fixing grooves 117*f*. This means a state where the plurality of shutters 120 are maximally open.

The aerosol generation device may include a third aperture 141 connected to the first aperture 111 and the second aperture 131, and may further include a cover 140 that is coupled to the second housing 130. The cover 140 may improve the aesthetic by covering the upper surface of the second housing 130.

FIG. 9 is a perspective plan view illustrating a state in which the plurality of shutters 120 of the aerosol generation device of FIG. 7 are closed.

FIG. 9 illustrates that the plurality of shutters 120 are brought together and meshed to close the first aperture 111 and the second aperture 131. In other words, each of the plurality of shutters 120 contacts other shutters 120 by rotating clockwise about the first rotation shafts 121. In the case of FIG. 9, three shutters 120 are brought together to close the first aperture 111 and the second aperture 131.

Although described above, a state in which the plurality of shutters 120 close the first aperture 111 and the second aperture 131 refers to a normal state in which there is no manipulation by a user to rotate the second housing 130. In this case, the elastic members 114 may be seated on two sides of the seating grooves 112 each having a fan shape and may apply certain restoration force to the plurality of shutters 120 via the elastic protrusions 114*p* such that the elastic members 114 shrink to the shape shown in FIG. 10. At this time, the elastic protrusions 114*p* may be positioned at the first point P1 within the guiding holes 123 of the plurality of shutters 120.

However despite this restoration force, the plurality of shutters 120 maintain a closed state, because, as described above, the pressing protrusions 133 fix the plurality of shutters 120 such that the plurality of shutters 120 are maintained closed and also because the guiding protrusions 122 of the plurality of shutters 120 are accommodated in the fixing grooves 117*f*.

According to a structure as described above, when the user does not rotate the second housing 130, the plurality of shutters 120 may maintain the state of closing the first aperture 111 and the second aperture 131. Accordingly, in the aerosol generation device according to another exemplary embodiment of the present disclosure of FIGS. 7 through 10, internal smells or foreign materials may be prevented from leaking to the outside which may be caused when the accommodating space of the aerosol generation device is arbitrarily opened even when there is no manipulation by the user.

Each of the plurality of shutters 120 may further include a step 124 protruding toward another shutter 120, and a step groove 125 accommodating the step 124. As shown in FIG. 9, when the plurality of shutters 120 close the first aperture 111 and the second aperture 131, respective portions of gaps formed between the plurality of shutters 120 may be closed by the steps 124, and at the same time respective other portions of the gaps between the plurality of shutters 120 may be open.

As described above, the internal accommodating space of the aerosol generation device is closed by pushing the plurality of shutters 120 to each other. As such, a smell of the cigarette 7 remaining after use within the aerosol generation device may be prevented from being rapidly diffused to the outside. In addition, due to application of a structure that opens a certain space between the plurality of shutters 120, heat remaining after use within the aerosol generation device may be discharged to the outside, thereby cooling down the aerosol generation device.

FIG. 10 is a perspective plan view illustrating a state in which the plurality of shutters 120 of the aerosol generation device of FIG. 7 are opened.

FIG. 10, as compared with FIG. 9, illustrates a state in which the plurality of shutters 120 open the first aperture 111 and the second aperture 131 as a result of a user rotating the second housing 130 in the counterclockwise direction (from the position 134*a* to the position 134*b*) by manipulating the manipulating part 134.

When the second housing 130 rotates in the counterclockwise direction, the pressing protrusions 133 formed in the second housing 130 also rotate in the counterclockwise direction (from the location 133*a* of FIG. 9 to the location 133*b* of FIG. 10) with the rotation of the second housing 130, thereby allowing rotation of the plurality of shutters 120. Thus, the plurality of shutters 120 rotate in the counterclockwise direction. In this case, the rotation force of the plurality of shutters 120 is caused by a structure in which, as described above, restoration force of the elastic members 114 is transmitted to the plurality of shutters 120 via the elastic protrusions 114*p* that are movable along the guiding holes 123 of the plurality of shutters 120.

In detail, when the second housing 130 rotates in the counterclockwise direction due to rotation manipulation by the user, the elastic protrusions 114*p* move in a direction away from the first rotation shafts 121 along the guiding holes 123. Accordingly, one side of each of the elastic members 114, which includes the elastic protrusions 114*p*, from among two sides of the elastic members 114 maximally expanded to be seated on the sides of the seating grooves 112, rotates in the counterclockwise direction about the protruding members 113 as the elastic protrusions 114*p* moves. Consequently, the plurality of shutters 120 also rotate in the counterclockwise direction about the first rotation shafts 121 and thus operate to open the first aperture 111 and the second aperture 131.

In other words, when the user rotates the second housing 130 in the counterclockwise direction, the elastic protrusions 114*p* move to the second point P2 opposite to the first point P1 within the guiding holes 123 such that the plurality of shutters 120 open the first aperture 111 and the second aperture 131.

When the elastic protrusions 114*p* are located at the first point P1, the elastic protrusions 114*p* may receive the restoration force of the elastic members 114 in a direction from the first point P1 back to the second point P2. This means that the plurality of shutters 120 may maintain in an open state as shown in FIG. 10 until the user closes the plurality of shutters 120 by manipulating the second housing 130 clockwise again.

In other words, once the plurality of shutters 120 open the first aperture 111 and the second aperture 131 as shown in FIG. 10, the open state may be maintained without user's continuous manipulation of the second housing 130, and thus the user may conveniently insert the cigarette 7 into the accommodating space.

In other words, the user may conveniently open or close the internal accommodating space of the aerosol generation device by using one hand, and furthermore may not need to separately store a component for opening or closing the internal accommodating space of the aerosol generation device, thereby reducing user's concern about loss.

Figure 11:
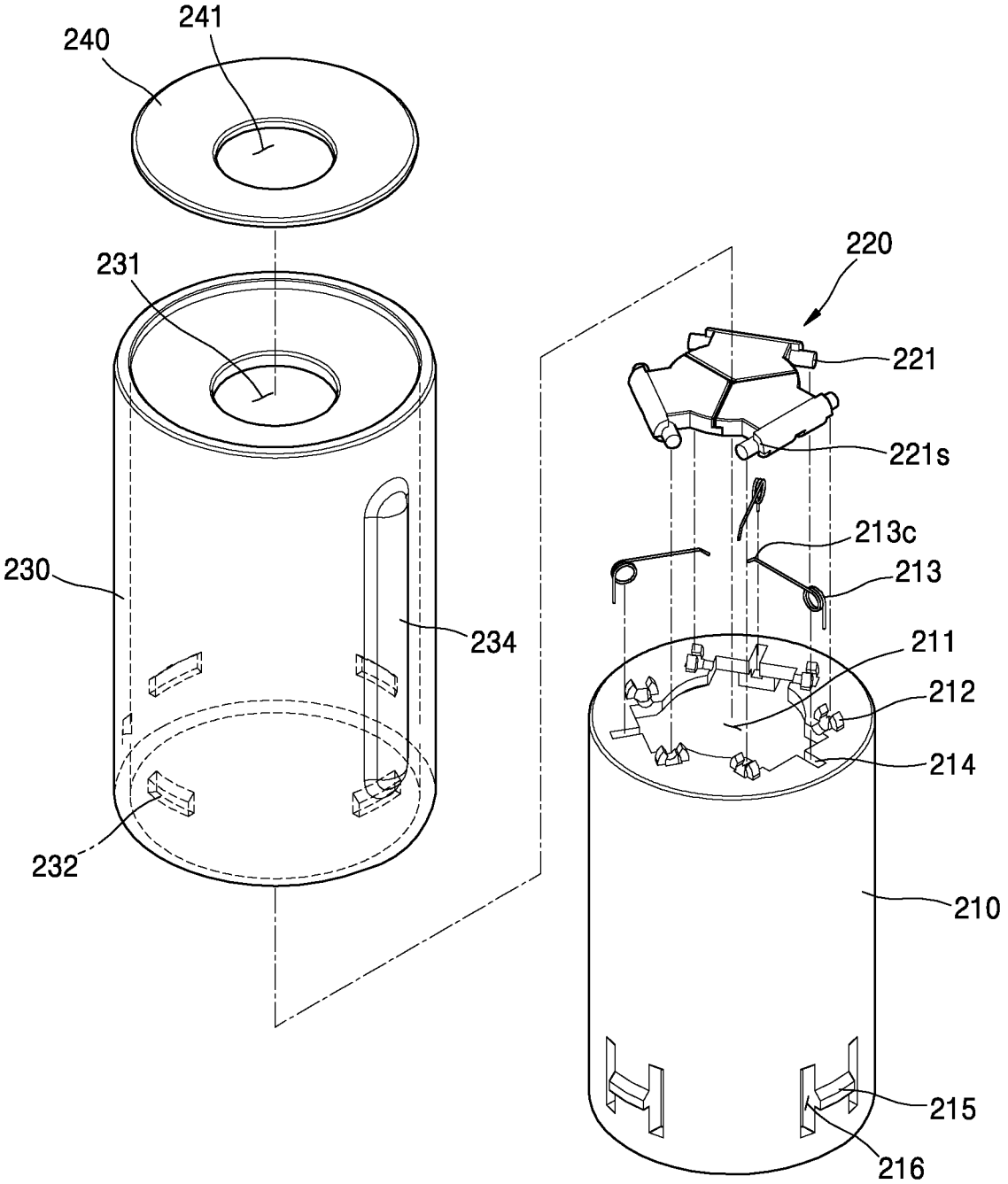
FIG. 11 is a schematic exploded perspective view illustrating a combinational relationship between some components of an aerosol generation device according to another exemplary embodiment of the present disclosure.

FIG. 11 is a schematic exploded perspective view illustrating a combinational relationship between some components of an aerosol generation device according to another exemplary embodiment of the present disclosure.

In the aerosol generation device according to the exemplary embodiment of FIG. 11, without a need for a user to manipulate a first housing 210 or a second housing 230, a plurality of shutters 220 may be opened or closed automatically by inserting the cigarette 7 into the accommodating space of the aerosol generation device and extracting the cigarette 7 from the accommodating space.

Referring to FIG. 11, the aerosol generation device includes the first housing 210 including a first aperture 211 via which the cigarette 7 is inserted, and the plurality of shutters 220, which are provided on the first housing 210 to be rotatable about a virtual line extending in the width direction of the cigarette 7 and open or close the first aperture 211.

The plurality of shutters 220 may be provided in the first housing 210 on a same plane and may be arranged circumferentially with respect to the center of the first aperture 211.

In detail, the plurality of shutters 220 include third rotation shafts 221 each extending in the width direction of the cigarette 7, and stoppers 221*s* respectively defining critical positions at which the plurality of shutters 220 may rotate about the third rotation shafts 221. The first housing 210 includes accommodating parts 212 rotatably accommodating the third rotation shafts 221.

Figure 12:
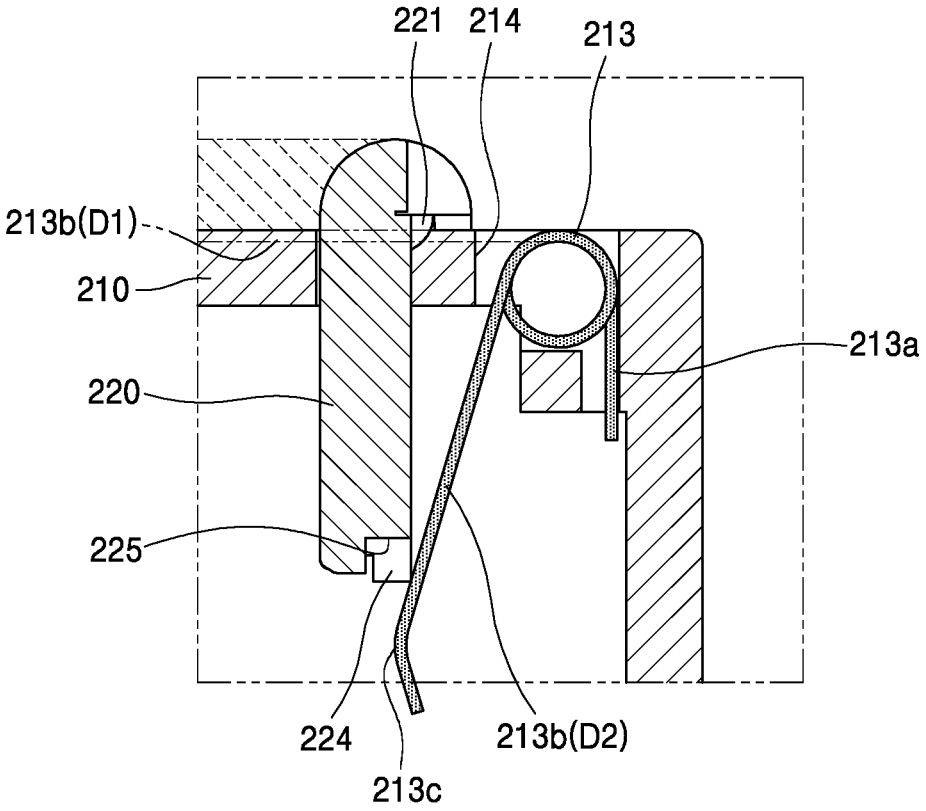
FIG. 12 is a magnified cross-sectional view illustrating a combinational relationship between some components of the aerosol generation device of FIG. 11.

The aerosol generation device further includes elastic members 213 that elastically support the first housing 210 and the plurality of shutters 220 such that the plurality of shutters 220 may elastically move between a first point D1 of FIG. 12 for closing the first aperture 211 and a second point D2 of FIG. 12 for opening the first aperture 211.

The first housing 210 further includes maintaining protrusions 215 protruding toward the second housing 230, and the second housing 230 further includes maintaining grooves 232 accommodating the maintaining protrusions 215. When the first housing 210 and the second housing 230 are coupled to each other, the maintaining protrusions 215 may fit into the maintaining grooves 232. To this end, upper surfaces of the maintaining protrusions 215 may be slant surfaces.

Due to this structure, when the first housing 210 is inserted into the second housing 230 and slides upwards, friction between the maintaining protrusions 215 and the second housing 230 may be minimized, and, after the maintaining protrusions 215 are coupled to the maintaining grooves 232 by simply fitting into the maintaining grooves 232, the maintaining protrusions 215 may fix the first housing 210 to the second housing 230 such that the first housing 210 is not separated downwards from the second housing 230.

The aerosol generation device may include a third aperture 241 connected to the first aperture 211 and the second aperture 231, and may further include a cover 240 that is coupled to the second housing 230. The cover 240 may improve the aesthetic by covering the upper surface of the second housing 230.

FIG. 12 is a magnified cross-sectional view illustrating a combinational relationship between some components of the aerosol generation device of FIG. 11.

Referring to FIG. 12, the elastic members 213 may be seated on installation holes 214 formed in the first housing 210, and one side 213*a* of each of the elastic members 213 may be supported by the inner surface of the first housing 210. The other side 213*b* of the elastic members 213 may be supported by the inner surface of the plurality of shutters 220. Curved portions 213*c* may be formed on the other side 213*b* of the elastic members 213, which slidingly contact the inner surface of the plurality of shutters 220. The curved portions 213*c* may be formed to have a round shape such that the elastic members 213 smoothly slide the inner surface of the plurality of shutters 220.

In detail, because the curved portions 213*c* directly contact the inner surface of the plurality of shutters 220 when the plurality of shutters 220 are opened or closed, if the curved portions 213*c* have pointy cross-sections instead of round shapes, the inner surface of the plurality of shutters 220 may be scratched and thus residues due to the scratching may permeate into the accommodating space. However, in the case of FIG. 12, because the respective inner surface of the plurality of shutters 220 and the curved portion 213*c* may smoothly slide each other, scratching of the respective inner surfaces of the plurality of shutters 220 and permeation of residues due to the scratching into the accommodating space may be prevented.

In detail, one side 213*a* of the elastic members 213 may be fixed to a location shown in FIG. 11 regardless of opening or closing of the plurality of shutters 220, and the other side 213*b* of the elastic members 213 may elastically move between the first point D1 and the second point D2 according to opening or closing of the plurality of shutters 220. In other words, when the plurality of shutters 220 are closed, the other side 213*b* of the elastic members 213 may be located at the first point D1, and, when the plurality of shutters 220 are opened, the other side 213*b* of the elastic members 213 may be located at the second point D2.

According to such a structure, when the cigarette 7 is not inserted into the accommodating space of the aerosol generation device, the plurality of shutters 220 may maintain a position that closes the first aperture 211 and the second aperture 231 as shown in FIG. 11. In addition, even when the cigarette 7 is inserted into the accommodating space and the plurality of shutters 220 are temporarily open, when the cigarette 7 is separated from the accommodating space after being used, the plurality of shutters 220 may return to the position that closes the first aperture 211 and the second aperture 231.

Figure 13:
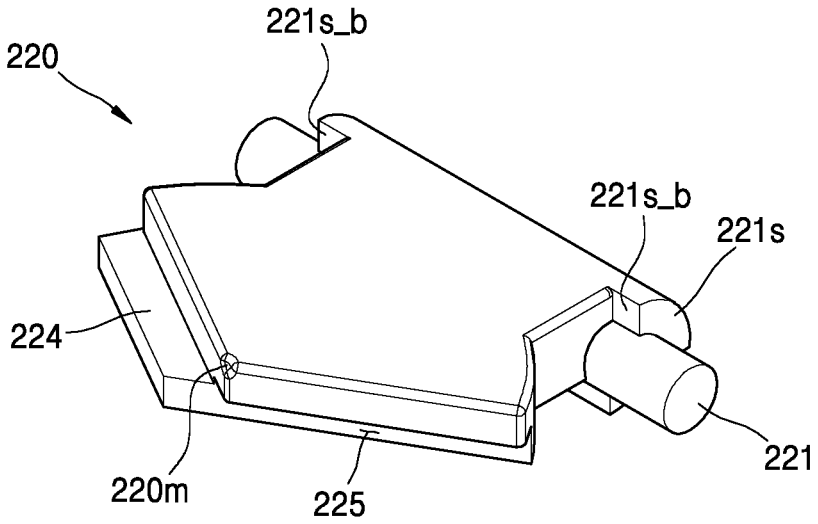
FIG. 13 is a perspective view of each of a plurality of shutters of the aerosol generation device of FIG. 11.
Figure 14:
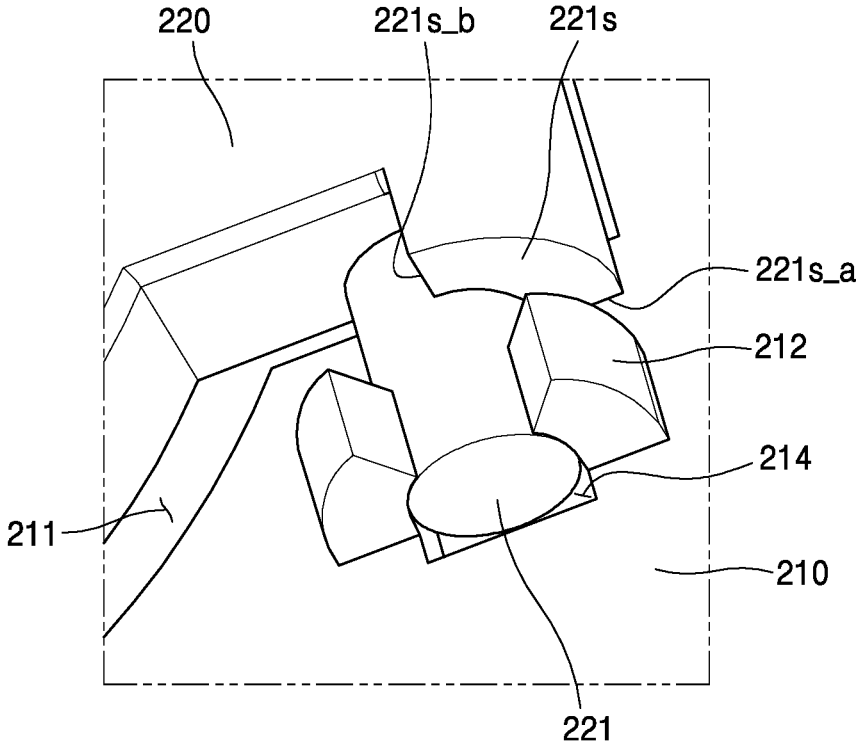
FIG. 14 is a magnified perspective view illustrating a combinational relationship between a first housing and the plurality of shutters of the aerosol generation device of FIG. 11.

FIG. 13 is a perspective view of each of the plurality of shutters 220 of the aerosol generation device of FIG. 11, and FIG. 14 is a magnified perspective view illustrating a combinational relationship between the first housing 210 and each of the plurality of shutters 120 of the aerosol generation device of FIG. 11.

Referring to FIGS. 13 and 14, the shutter 220 includes the third rotation shaft 221 that is rotatably accommodated in the accommodating part 212 of the first housing 210, and the stopper 221*s* for preventing rotation of the third rotation shaft 221 in a direction of closing the first aperture 211 by contacting the first housing 210 when the plurality of shutters 220 close the first aperture 211, and preventing rotation of the third rotation shaft 221 in a direction of opening the first aperture 211 by contacting the first housing 210 when the plurality of shutters 220 open the first aperture 211.

FIG. 14 illustrates the stopper 221*s* of which one side surface 221*s_a* is in contact with the first housing 210 when the shutter 220 is closed. When the one side surface 221*s_a* of the stopper 221*s* engages with the first housing 210, clockwise rotation of the third rotation shaft 221 shown in FIG. 14 may be prevented.

The clockwise rotation of the third rotation shaft 221 corresponds to a direction in which the shutter 220 closes the first aperture 211. However, if the shutter 220 rotates further upwards than a location shown in FIG. 13, the first aperture 211 may be re-opened. Accordingly, when the shutter 220 rotates clockwise about the third rotation shaft 221 up to the position that closes the first aperture 211, namely, a location where the shutter 220 is arranged in a horizontal direction as shown in FIG. 14. To this end, the third rotation shaft 221 may include the stopper 221*s* such that the third rotation shaft 221 may rotate up to the position where the one side surface 221*s_a* of the stopper 221*s* engages with the first housing 210.

Although not shown in the drawings, when the other side surface 221*s_b* of the stopper 221*s* engages with the first housing 210, counterclockwise rotation of the third rotation shaft 221 shown in FIG. 14 may be prevented. Because the counterclockwise rotation of the third rotation shaft 221 corresponds to a direction in which the shutter 220 opens the first aperture 211, the shutter 220 may rotate in the counterclockwise direction about the third rotation shafts 221 to open the first aperture 211. However, the third rotation shaft 221 may not rotate beyond the position where the other side surface 221*s_b* of the stopper 221*s* engages with the first housing 210.

Figure 15:
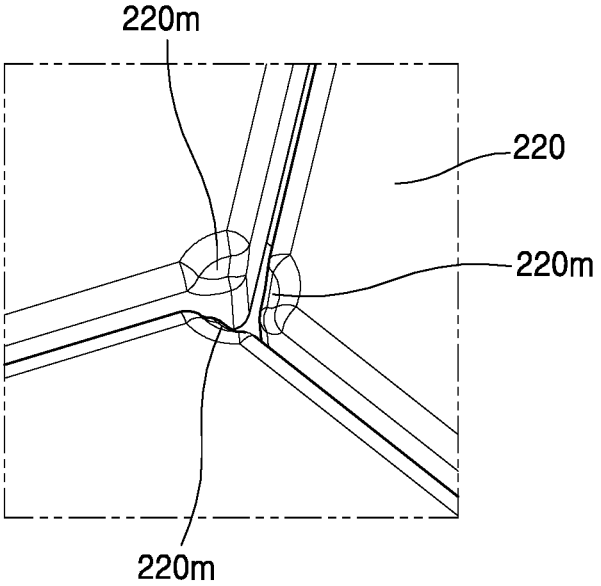
FIG. 15 is a magnified perspective view illustrating a case where the plurality of shutters of the aerosol generation device of FIG. 11 are closed.

FIG. 15 is a magnified perspective view illustrating a case where the plurality of shutters 220 of the aerosol generation device of FIG. 11 are closed.

As shown in FIG. 15, the corner portions 220*m* of the plurality of shutters 220, which are adjacent to the center of the first aperture 211 when the plurality of shutters 220 close the first aperture 211, may be chamfered.

The respective corner portions 220*m* of the plurality of shutters 220 are the last points of contact with the cigarette 7 when the cigarette 7 is separated from the aerosol generation device. Thus, if the corner portions 220*m* are processed to be pointy, the pointy corner portions 220*m* may scratch the outer surface of the cigarette 7 when the cigarette 7 is separated, and thus may damage the cigarette 7. When the cigarette 7 is damaged by the corners of the plurality of shutters 220, various materials used to form the cigarette 7 may flow into the accommodating space of the aerosol generation device. In this case, the accommodating space may need to be additionally cleaned.

However, if the respective corner portions 220*m* of the plurality of shutters 220 are chamfered as shown in FIG. 15, the cigarette may be safely separated from the aerosol generation device without damage to the cigarette 7, and thus residues of the cigarette 7 after use may be prevented from flowing into the accommodating space.

Moreover, each of the plurality of shutters 220 includes the step 224 protruding toward another shutter 220, and the step groove 225 accommodating the step 224. As shown in the bottom of FIG. 16, when the plurality of shutters 220 close the first aperture 211 and the second aperture 231, a portion of gaps formed between the plurality of shutters 220 may be closed by the steps 224, and at the same time other portion of the gaps between the plurality of shutters 220 may be open.

According to the above-described structure, the internal accommodating space of the aerosol generation device is closed by bringing the plurality of shutters 220 together, thereby preventing a smell of the cigarette 7 remaining after use within the aerosol generation device from being rapidly diffused to the outside. In addition, due to application of a structure that opens a certain space between the plurality of shutters 220, heat remaining after use within the aerosol generation device may be discharged to the outside, thereby cooling down the aerosol generation device.

Figure 16:
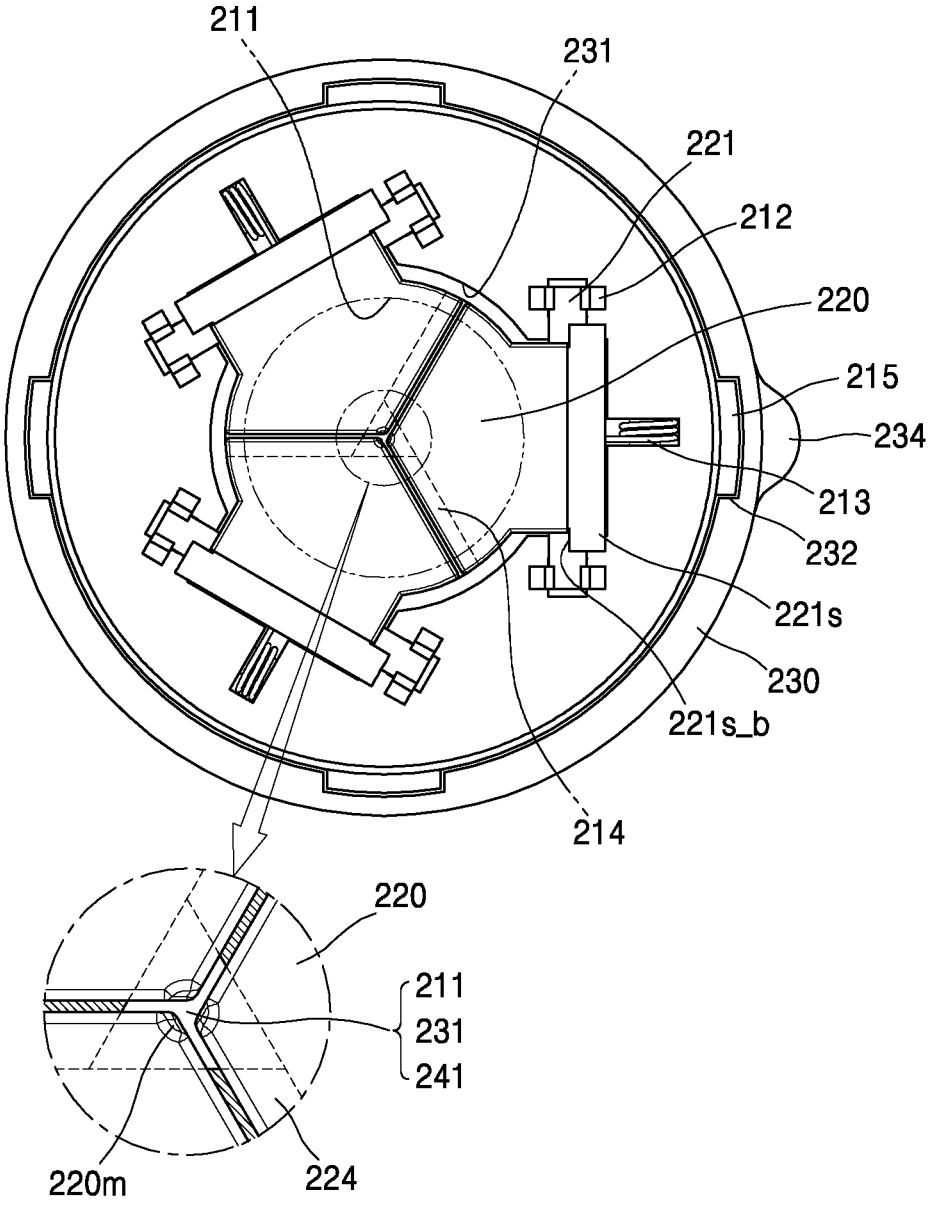
FIG. 16 is a perspective plan view illustrating a state in which the plurality of shutters of the aerosol generation device of FIG. 11 are closed.

FIG. 16 is a perspective plan view illustrating a state in which the plurality of shutters 220 of the aerosol generation device of FIG. 11 are closed.

FIG. 16 illustrates that the plurality of shutters 220 are brought together and meshed to close the first aperture 211 and the second aperture 231. In other words, each of the plurality of shutters 220 contacts other shutters 220 by rotating about the third rotation shafts 221. In the case of FIG. 15, three shutters 220 are brought together to close the first aperture 211 and the second aperture 231.

As described above, a state in which the plurality of shutters 220 close the first aperture 211 and the second aperture 231 refers to a normal state in which the cigarette 7 is not inserted into the accommodating space of the aerosol generation device. In this case, the respective other sides 213*b* of the elastic members 213 may maintain a maximally expanded state by being located at the first point D1 as shown in FIG. 12.

According to a structure as described above, when a user does not insert the cigarette 7 into the accommodating space of the aerosol generation device, the plurality of shutters 220 may maintain the state of closing the first aperture 211 and the second aperture 231. Accordingly, in the aerosol generation device according to another exemplary embodiment of the present disclosure of FIGS. 11 through 17, the accommodating space of the aerosol generation device may be prevented from being arbitrarily opened even when there is no manipulation by the user, and thus leakage of internal smells or foreign materials to the outside may be prevented.

Figure 17:
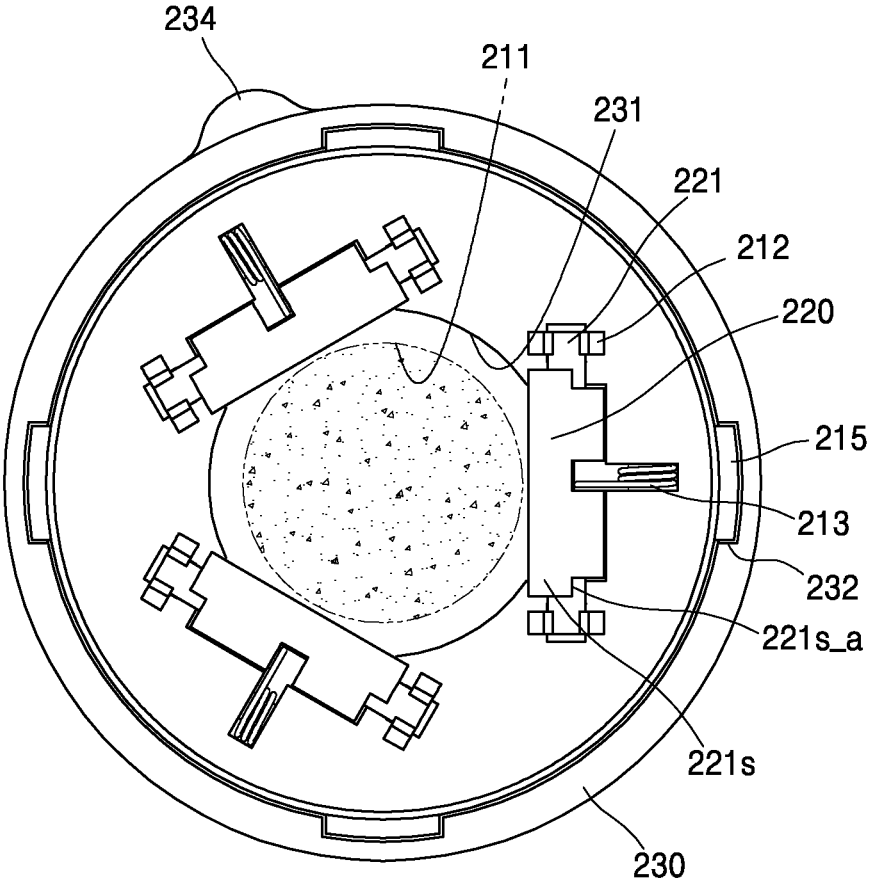
FIG. 17 is a perspective plan view illustrating a state in which the plurality of shutters of the aerosol generation device of FIG. 11 are opened.

FIG. 17 is a perspective plan view illustrating a state in which the plurality of shutters 220 of the aerosol generation device of FIG. 11 are opened.

FIG. 17 illustrates a state in which the plurality of shutters 220 opened the first aperture 11 and the second aperture 31 as a result of a user inserting the cigarette 7 into the internal accommodating space via the first aperture 211 and the third aperture 231 of the aerosol generation device. In this case, the other side 213*b* of the elastic members 213 may be located at the second point D2 as shown in FIG. 11, and may press the lower surface of the plurality of shutters 220 by restoration force to move the other side 213*b* from the second point D2 back to the first point D1.

While the cigarette 7 is in the accommodating space of the aerosol generation device, even when the other side 213*b* of the elastic members 213 applies a restoration force to the lower surface of the plurality of shutters 220, the plurality of shutters 220 may maintain the open state.

However, when a user separates the cigarette 7 from the accommodating space of the aerosol generation device, the plurality of shutters 220 may return to the location of closing the first aperture 211 and the second aperture 231 by rotating about the third rotation shafts 221 again due to the restoration force applied by the other side 213*b* of the elastic members 213 to the lower surface of the plurality of shutters 220.

In the aerosol generation device according to another exemplary embodiment of the present disclosure of FIGS. 11 through 17, without having to manipulate the first housing 210 or the second housing 230, a user may open or close the plurality of shutters 220 simply by inserting the cigarette 7 into the accommodating space of the aerosol generation device and extracting the cigarette 7 from the accommodating space after the cigarette 7 is used.

Accordingly, while a user is holding the aerosol generation device with one hand, the user may simply perform an operation of inserting and separating the cigarette 7 into and from the aerosol generation device with the other hand. Also, leakage of internal smells or foreign materials, which may be caused when the accommodating space of the aerosol generation device is arbitrarily opened even when there is no manipulation by the user, may be prevented.

Furthermore, as described above, the internal accommodating space of the aerosol generation device is closed by bringing the plurality of shutters 220 together, thereby preventing a smell of the cigarette 7 remaining after use within the aerosol generation device from being rapidly diffused to the outside. In addition, a certain space is formed between the plurality of shutters 220, so heat remaining after use within the aerosol generation device may be discharged to the outside, thereby cooling down the aerosol generation device.

The configuration and effects of the above-described embodiments are merely exemplary, and it will be understood by one of ordinary skill in the art that various modifications and equivalent other embodiments may be made. Therefore, the scope of the disclosure should be determined by the accompanying claims.

What is claimed is:

1. An aerosol generation device comprising:

a first housing comprising a first aperture into which a cigarette is to be inserted;

a plurality of shutters provided on the first housing to be rotatable about a virtual line extending in a lengthwise direction of the cigarette, and configured to open and close the first aperture; and a second housing comprising a second aperture that communicates with the first aperture, surrounding an outer circumferential surface of the first housing to be rotatable with respect to the first housing, slidably contacting the plurality of shutters, and configured to rotate the plurality of shutters according to a rotating manipulation by a user.

2. The aerosol generation device of claim 1, wherein the first housing further comprises first rotation shafts that protrude toward the plurality of shutters, the plurality of shutters comprise rotation holes that accommodate the first rotation shafts, and the plurality of shutters are rotatable about the first rotation shafts.

3. The aerosol generation device of claim 1, wherein the plurality of shutters are provided in the first housing on a same plane and are arranged circumferentially with respect to the center of the first aperture.

4. The aerosol generation device of claim 1, wherein the plurality of shutters comprise guiding protrusions that protrude toward the first housing, the first housing further comprises guiding grooves that accommodate the guiding protrusions, and the guiding protrusions are slidable along the guiding grooves with rotation of the plurality of shutters.

5. The aerosol generation device of claim 4, wherein the guiding grooves comprise:

fixing grooves configured to accommodate the guiding protrusions when the plurality of shutters close the first aperture and the second aperture; and moving grooves configured to slidably accommodate the guiding protrusions when the plurality of shutters open the first aperture and the second aperture, and wherein the guiding protrusions accommodated in the fixing grooves are fixed to the fixing grooves unless force greater than or equal to a threshold is applied to the plurality of shutters.

6. The aerosol generation device of claim 1, wherein the first housing further comprises maintaining protrusions that protrude toward the second housing, the second housing further comprises maintaining grooves configured to slidably accommodate the maintaining protrusions, the maintaining protrusions are slidable along the maintaining grooves with rotation of the second housing with respect to the first housing, and based on the maintaining protrusions being accommodated in the maintaining grooves, movement of the second housing with respect to the first housing in a lengthwise direction of the cigarette is prevented.

7. The aerosol generation device of claim 1, wherein the first housing further comprises air flow holes allowing an air flow between the first housing and the second housing.

8. The aerosol generation device of claim 1, wherein the plurality of shutters comprise cam protrusions that protrude toward the second housing, the second housing further comprises cam holes configured to slidably accommodate the cam protrusions, based on the user rotating the second housing, rotation of the second housing is delivered to the cam protrusions accommodated in the cam holes, and the cam protrusions rotate the plurality of shutters by sliding along the cam holes.

9. The aerosol generation device of claim 1, wherein each of the plurality of shutters comprises:

a step protruding toward another shutter; and a step groove configured to accommodate the step.

10. The aerosol generation device of claim 9, wherein based on the plurality of shutters closing the first aperture and the second aperture, a portion of a gap formed between the plurality of shutters is closed by the step, and another portion of the gap formed between the plurality of shutters is opened.

11. The aerosol generation device of claim 1, wherein the second housing further comprises a manipulation part that protrudes outwards from an outer circumferential surface of the second housing.

12. The aerosol generation device of claim 1, further comprising a cover comprising a third aperture connected to the first and second apertures, the cover being coupled to the second housing.

13. The aerosol generation device of claim 1, wherein the second housing further comprises pressing protrusions configured to rotate the plurality of shutters by pressing the plurality of shutters according to rotation manipulation by the user.

14. The aerosol generation device of claim 13, wherein the first housing further comprises:

seating grooves inwardly formed opposite the plurality of shutters;

protruding members formed on the seating grooves and protruding toward the plurality of shutters, elastic members provided on the seating grooves around the protruding members so as to have elastic force, each elastic member having one end on which an elastic protrusion protruding toward the plurality of shutters is formed;

fixing protrusions respectively fixing the elastic members onto the seating grooves;

accommodating holes rotatably accommodating the plurality of shutters; and guiding grooves guiding rotation of the plurality of shutters, wherein the plurality of shutters comprise:

second rotation shafts protruding toward the first housing and rotatably accommodated in accommodating holes;

guiding protrusions protruding toward the first housing and accommodated in the guiding grooves of the first housing; and guiding holes slidably accommodating the elastic protrusions, wherein the elastic protrusions are slidable along the guiding holes with rotation of the second housing with respect to the first housing, and wherein the guiding protrusions are slidable along the guiding grooves with rotation of the second housing with respect to the first housing.

15. The aerosol generation device of claim 14, wherein once the plurality of shutters open or close the first aperture and the second aperture, the plurality of shutters maintains opening or closing of the first aperture and the second aperture unless the user rotates the second housing.

16. The aerosol generation device of claim 14, wherein the elastic protrusions are located at a first point within the guiding holes such that the plurality of shutters close the first aperture and the second aperture, the elastic protrusions are located at a second point opposite to the first point within the guiding holes such that the plurality of shutters open the first aperture and the second aperture, and while the elastic protrusions are located at the first point, the elastic protrusions receive restoration force of the elastic members in a direction from the first point to the second point.

17. An aerosol generation device comprising:

a first housing comprising a first aperture into which a cigarette is to be inserted;

a plurality of shutters provided on the first housing to be rotatable about a virtual line extending in a width direction of the cigarette, and configured to open and close the first aperture; and elastic members configured to elastically support the first housing and the plurality of shutters such that the plurality of shutters elastically move between a first point for closing the first aperture and a second point for opening the first aperture.

18. The aerosol generation device of claim 17, wherein the plurality of shutters are provided in the first housing on a same plane and are arranged circumferentially with respect to the center of the first aperture.

19. The aerosol generation device of claim 17, wherein the plurality of shutters comprise third rotation shafts each extending in the width direction of the cigarette, and stoppers respectively defining critical positions of the plurality of shutters rotating about the third rotation shafts, and the first housing comprises an accommodating part configured to rotatably accommodate the third rotation shafts.

20. The aerosol generation device of claim 17, wherein the elastic members are seated on installation holes formed in the first housing, and one side of each elastic member is supported by an inner surface of the first housing and another side of each elastic member is supported by an inner surface of each of the plurality of shutters.

21. The aerosol generation device of claim 17, wherein a portion of each of the plurality of shutters, which is adjacent to the center of the first aperture when the plurality of shutters close the first aperture, is chamfered.

* * * * *